US005967616A

United States Patent [19]

Offutt et al.

[11] Patent Number: 5,967,616

[45] Date of Patent: Oct. 19, 1999

[54] ELECTRICAL CONTROL SYSTEM FOR APPARATUS AND METHOD FOR CONTINUOUS UNDERGROUND MINING

[75] Inventors: Larry G. Offutt, Shorncliffe, Australia; David A. Christopher, Idamy, W. Va.

[73] Assignee: Arch Technology Corporation, St. Louis, Mo.

[21] Appl. No.: 09/037,405

[22] Filed: Mar. 10, 1998

Related U.S. Application Data

[63] Continuation-in-part of application No. 08/530,748, Sep. 19, 1995, Pat. No. 5,810,447, which is a continuation of application No. 08/428,952, Apr. 26, 1995, abandoned.

[51] Int. Cl.[6] ..... E21C 35/24

[52] U.S. Cl. ..... 299/30; 299/64; 299/67

[58] Field of Search ..... 299/30, 37, 18, 299/43, 44, 63, 64, 67

[56] References Cited

U.S. PATENT DOCUMENTS

| | | | |
|---|---|---|---|
| 2,826,402 | 3/1958 | Alspaugh et al. . | |
| 3,225,678 | 12/1965 | Densmore . | |
| 3,826,535 | 7/1974 | Fujimori et al. | 299/1.6 |
| 3,858,940 | 1/1975 | Lagowski | 299/18 |
| 4,192,551 | 3/1980 | Weimer et al. | 299/1.4 |
| 4,281,876 | 8/1981 | Lansberry | 299/1.4 |
| 4,312,540 | 1/1982 | Thompson | 299/11 |
| 4,418,872 | 12/1983 | Nelson | 241/187 |
| 4,474,287 | 10/1984 | Thompson | 198/812 |
| 4,596,424 | 6/1986 | Wilcox, Jr. et al. | 299/64 |
| 4,773,520 | 9/1988 | Doerr et al. | 198/301 |
| 4,784,257 | 11/1988 | Doerr | 198/594 |
| 4,798,279 | 1/1989 | Doerr et al. | 198/594 |
| 4,819,273 | 4/1989 | Gordon | 299/30 X |
| 4,852,724 | 8/1989 | Bodimer | 198/861.2 |
| 4,865,185 | 9/1989 | Bodimer | 198/861.2 |
| 4,869,358 | 9/1989 | Chandler | 299/11 X |
| 4,884,847 | 12/1989 | Bessinger et al. | 299/1 |
| 4,957,405 | 9/1990 | Roberts et al. | 414/339 |
| 4,969,691 | 11/1990 | Moore et al. | 299/18 |
| 4,981,327 | 1/1991 | Bessinger et al. | 299/1 |
| 5,110,189 | 5/1992 | Haines | 299/30 |
| 5,112,111 | 5/1992 | Addington et al. | 299/18 |
| 5,161,857 | 11/1992 | Mayercheck et al. . | |
| 5,185,935 | 2/1993 | McMillion et al. | 33/1 |
| 5,232,269 | 8/1993 | Addington et al. | 299/67 |
| 5,261,729 | 11/1993 | Addington et al. | 299/64 |
| 5,348,130 | 9/1994 | Thomas | 198/312 |
| 5,364,171 | 11/1994 | Addington et al. | 299/18 |

FOREIGN PATENT DOCUMENTS

| | | |
|---|---|---|
| 1373170 | 11/1974 | United Kingdom . |
| 9502746 | 1/1995 | WIPO . |
| 9502747 | 1/1995 | WIPO . |

*Primary Examiner*—Frank Tsay
*Attorney, Agent, or Firm*—Webb Ziesenheim Logsdon Orkin & Hanson, P.C.

[57] ABSTRACT

Apparatus for controlling the operation of an underground mining system including a continuous miner, a roof bolting machine, a tramming conveyor and a control cab operatively connected to the tramming conveyor. The apparatus includes a master computer processor on the continuous miner and at least one slave computer processor under the direction of the master computer processor for controlling elements of the mining system other than the continuous miner. A pair of parallel data communication highways connect the master computer processor and the slave computer processor and the functional status of the data communication highways is monitored. A radio communication path is provided between the master computer processor and the mining system. The master computer processor operates the mining system in an automatic mining mode of operation when both data communication highways are functional and operates the mining system in a reverse mode of operation if either data communication highway fails to function. In the reverse mode, all mining operations stop and the mining system can be reversed out of a mine hole. The master computer processor operates the mining system in a manual, radio controlled mode of operation if both data communication highways cease to function.

12 Claims, 18 Drawing Sheets

ELECTRICAL CONTROL SYSTEM FOR APPARATUS AND METHOD FOR CONTINUOUS UNDERGROUND MINING

CROSS REFERENCE TO RELATED APPLICATIONS

This application is a continuation-in-part of application Ser. No. 08/530,748, filed Sep. 19, 1995, now U.S. Pat. No. 5,810,447, which is a continuation of application Ser. No. 08/428,952, filed Apr. 26, 1995, now abandoned.

BACKGROUND OF THE INVENTION

1. Field of the Invention

The invention relates generally to a system for continuously mining coal underground and, more particularly, to such a system having a substantially automatic sequential control for a continuous miner, a combination articulated haulage/tramming conveyor and a roof bolting machine therebetween.

2. Description of the Prior Art

Coal is typically found in substantially horizontal seams extending through rock strata such as limestone, sandstone or shale. Surface mining and underground mining are the primary methods used to mine coal. Surface mining may be strip mining which involves the removal of the overburden by means of a drag line or other earth moving equipment to fully expose the coal seam for recovery. However, strip mining is limited by the depth of the overburden, which eventually makes strip mining impractical. When the depth of the overburden makes strip mining impractical, a large quantity of coal may remain in a seam. Recovery of this coal is accomplished by highwall mining wherein an entry or a hole is initiated at the exposed face of the seam at the highwall, and mining follows the seam inwardly from the highwall. A method and apparatus of mining a highwall are disclosed in U.S. Pat. Nos. 5,364,171; 5,232,269; 5,261,729 and 5,112,111, respectively entitled "Apparatus and Method for Continuous Mining"; "Launch Vehicle for Continuous Mining Apparatus"; "Apparatus for Continuous Mining"; and "Apparatus and Method for Continuous Mining", which are owned by Mining Technologies, Inc. Early highwall mining technology included mobile conveyors such as disclosed in U.S. Pat. No. 4,957,405, entitled "Apparatus for Mining". A control for a continuous miner and a trailing conveyor which may be used in highwall mining is disclosed in U.S. Pat. No. 5,185,935, entitled "Method and Apparatus for Separation Measurement and Alignment System". A combination haulage and tramming conveyor is disclosed in United Kingdom Patent No. 1,373,170, entitled "Plate Conveyor".

When a coal seam is sufficiently deep, underground mining is utilized which often requires a bolter car to insert roof bolts to provide a stable roof above the workers.

SUMMARY OF THE INVENTION

We have invented a system for continuous underground mining that includes a continuous miner having a cutting means, a roof bolting machine having a front end operatively connected to and following a rear end of the continuous miner, an articulated tramming conveyor having an inby end operatively connected to and trailing a rear end of the roof bolting machine, and a control cab operatively connected to and trailing the tramming conveyor. In accordance with our invention, a master computer processor is provided on the continuous miner. At least one slave computer processor controls elements of the mining system other than the continuous miner and under the direction of the master computer processor. A pair of parallel data communication highways extends between the master computer processor and the slave computer processor. A radio communication path is provided between the master computer processor and an outby end of the tramming conveyor. Monitoring means are provided for monitoring the functional status of the data communication highways. The master computer processor includes means for operating the mining system in an automatic mining mode of operation when both of the data communication highways are functional. The master computer processor also includes means for operating the mining system in a reverse mode of operation if either of the data communication highways fails to function, whereby all mining operations cease and the mining system may be reversed out of a mine hole. Finally, the master computer processor includes means for operating the mining system in a manual, radio-controlled mode of operation using the radio communication path if both data communication highways cease to function, whereby the master computer processor stops all automatic operations and is controlled solely by control signals over the radio communication path.

A complete understanding of the invention will be obtained from the following description when taken in connection with the accompanying drawing figures wherein like reference characters identify like parts throughout.

DESCRIPTION OF THE PREFERRED EMBODIMENTS

Figure 2:
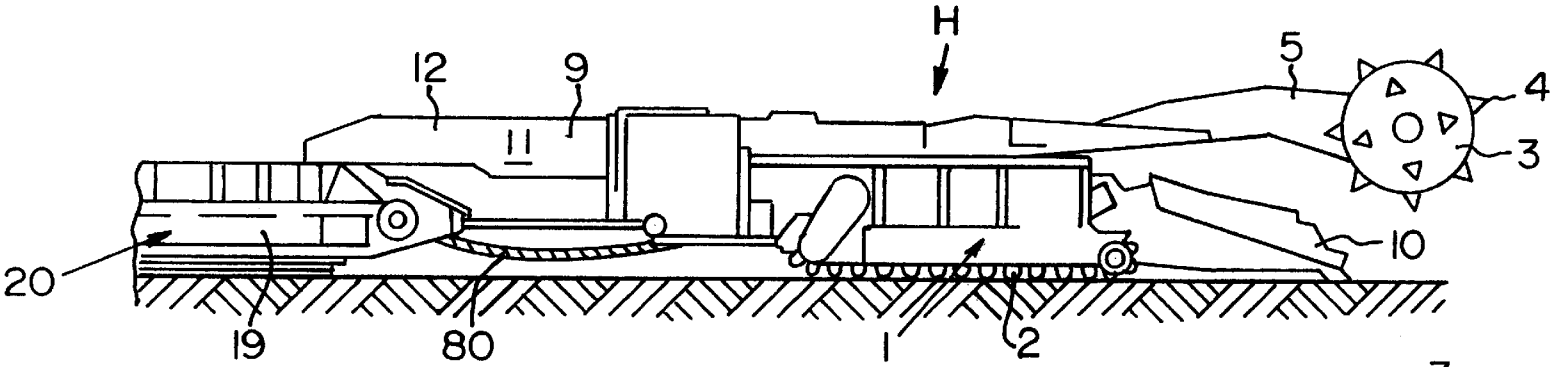
FIG. 2 is a schematic elevation of a portion of the mining system shown in FIG. 1.
Figure 1:
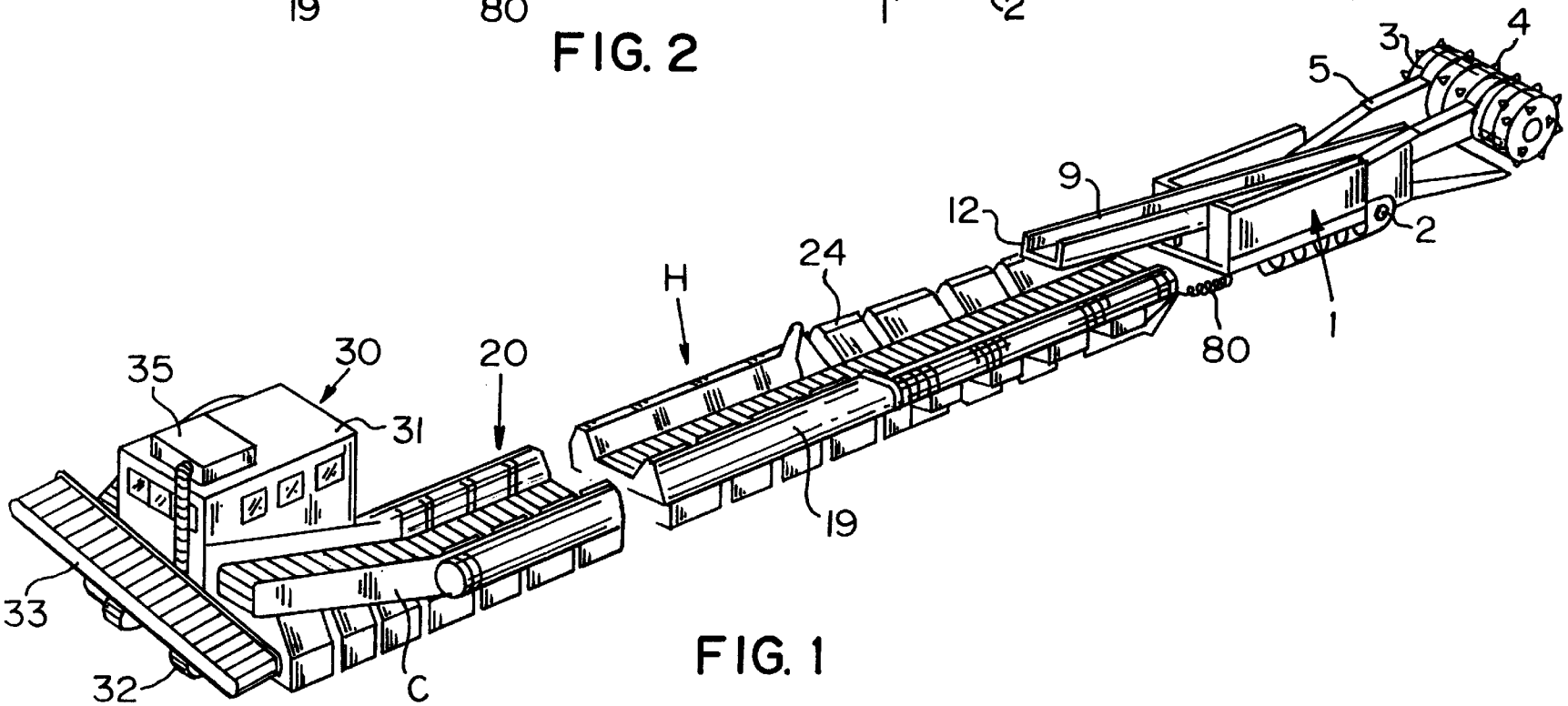
FIG. 1 is a broken perspective of a mining system in accordance with the present invention.
Figure 3:
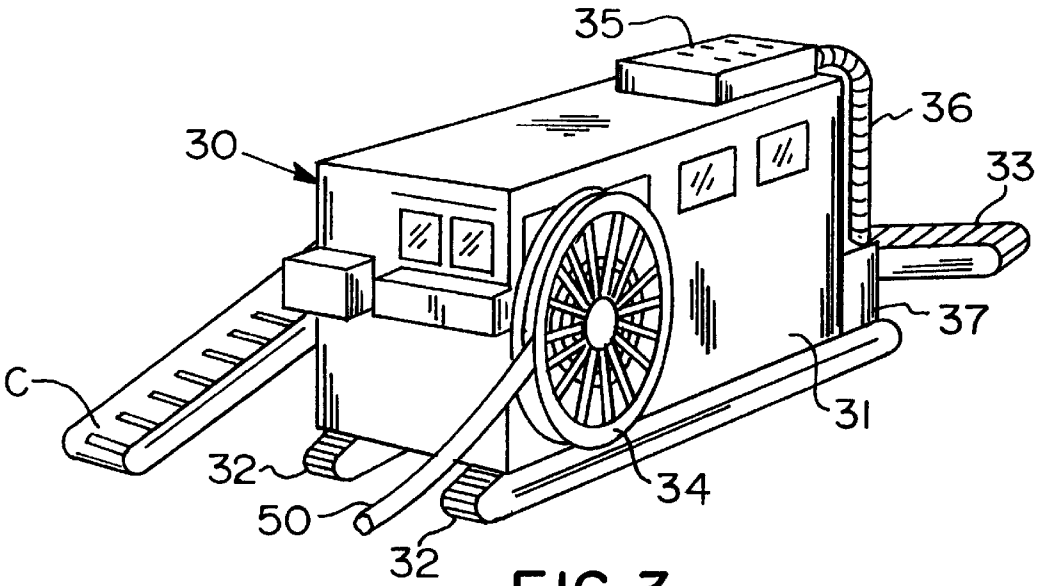
FIG. 3 is a perspective of the load-out vehicle shown in FIG. 1.

FIGS. 1 and 2 of the drawings show a highwall mining system H including a continuous miner 1 mounted on crawlers 2 and having a rotary cutting head 3 with cutting bits 4 on the circumference and the ends thereof. As will be discussed hereinafter in more detail, this mining system can also be used in underground mining with minor modifications. The rotary cutting head 3 is mounted on the distal ends of cutting head booms 5 which are pivoted to the frame of the continuous miner so that they can be raised and lowered to shear the complete vertical face of a coal seam at the inner end of a hole. The continuous miner is a J 14 CM manufactured by the Joy Manufacturing Company located in Franklin, Pa. with substantial modifications and additions according to the invention. However, other continuous miners may be used with appropriate modifications. A central discharge conveyor 9 extends rearwardly from a front end loading pan 10 to the rear end of a boom 11 extending beyond the rear end of the continuous miner. The rear end of central discharge conveyor 9 is located over hopper section 24 at the inby end of tramming conveyor 20. The mined coal on loading pan 10 of continuous miner 1 is moved onto central discharge conveyor 9 by a plurality of rotating sweep arms which are well-known to those skilled in the art. The central discharge conveyor transports the coal to the hopper section of tramming conveyor 20 which transports the coal rearwardly out of the hole.

Figure 4:
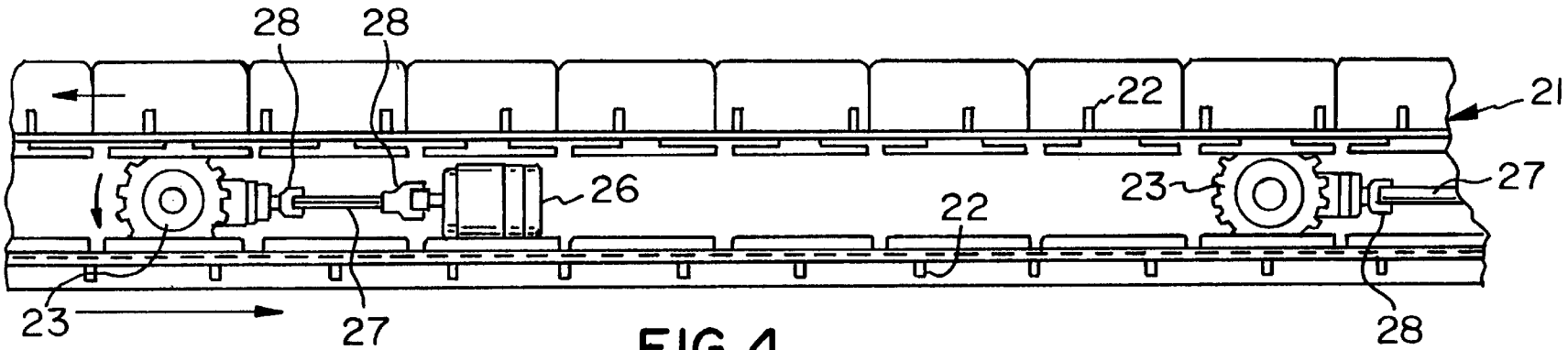
FIG. 4 is a schematic side elevation of a portion of the tramming conveyor shown in FIG. 1.
Figure 5:
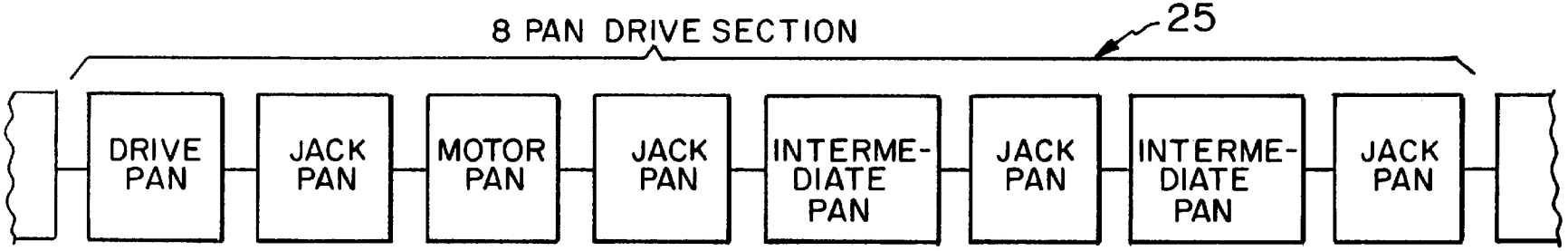
FIG. 5 is a schematic of an eight pan section of the tramming conveyor.

Tramming conveyor 20 has a continuous chain 21 with spaced flights 22. The chain is moved along the conveyor pan by electric motor driven sprockets 23 to transport mined coal rearwardly out of the hole when the tramming conveyor is in the raised position ("conveying mode") shown in FIG. 6 of the drawings. When the tramming conveyor 20 is in the lower position ("tramming mode") shown in FIG. 7 of the drawings, it trams along the mine floor as determined by the direction of travel of chain 21. The length of the tramming conveyor is determined by the distance between the face of the coal seam and the location of load-out vehicle 30. The tramming conveyor has a plurality of eight pan drive sections 25 as shown in FIGS. 4 and 5 of the drawings. A single drive section is described in detail hereinafter. As shown in FIG. 1 of the drawings, the tramming conveyor has a hopper section 24 at the inby end which has high angled side walls in order to contain the mined coal which is deposited on chain 21 by central discharge conveyor 9 on continuous miner 1. This hopper section supplies the mined coal to the rearwardly located sections of the tramming conveyor for continuous transport away from the continuous miner to load-out vehicle 30. As will be understood by those skilled in the art, the hopper section and the other sections of tramming conveyor 20 accept continuous chain 21 which is moved along the conveyor pan by spaced sprockets 23 which are driven by electric motors 26 in accordance with the arrangement shown in FIG. 4 of the drawings.

With reference to FIG. 4, each electric drive motor 26 is connected to one end of a drive shaft 27 by a universal joint 28. The opposite end of each drive shaft is connected to a sprocket 23 by a second universal joint 28 to rotate the sprocket. The chain is provided with spaced flights 22 and lugs or studs 29 extend outwardly from the outer edge of each flight to provide traction during tramming.

As shown in FIG. 5 of the drawings, each eight pan drive section includes a drive pan at one end containing a sprocket 23. A jack pan having hydraulic jacks is located adjacent to the drive pan, and a motor pan is located adjacent the other side of the jack pan. Drive shaft 27 which extends from motor 26 on the motor pan to sprocket 23 on the drive pan passes over the jack pan. A second jack pan is located on the opposite side of the motor pan and an intermediate pan is located adjacent to the jack pan. A second combination of a jack pan and an intermediate pan is located downstream of the intermediate pan, and another jack pan is located adjacent to the intermediate pan. As is apparent, every alternate pan in the section is a jack pan having the hydraulic jacks for raising and lowering tramming conveyor 20.

The load-out vehicle 30 is located at the outby end of tramming conveyor 20 and includes an operator cab 31 mounted on caterpillar tracks 32. The controls and computer screens are all located at the operator station in cab 31 so that they can be constantly monitored by the operator. Load-out vehicle 30 includes an outlet conveyor C on one side for transmitting mined coal from the outby end of tramming conveyor 20 onto a transverse conveyor 33 located perpendicular to the tramming conveyor and the outlet conveyor for transporting the coal laterally into trucks or onto a stationary belt conveyor (not shown). The load-out vehicle also supports electric power transformers, a cable reeler 34 which carries coils of power cable bundle 50 and maintains the cable relatively taut while the tramming conveyor and the continuous miner move relative to the load-out vehicle. As explained hereinafter, the end of the power cable bundle at the continuous miner is maintained under tension to minimize the sag in the cable between continuous miner 1 and trailing tramming conveyor 20.

The load-out vehicle includes a blower (not shown) located in a housing 35 on the roof which blows cooling air downwardly through a conduit 36 to a main transformer housing 37 located in the lower portion of the vehicle. It has been determined that this cooling air is essential to maintain the main electric power transformers at a sufficiently low temperature to permit substantially continuous operation of the transformers.

Figure 6:
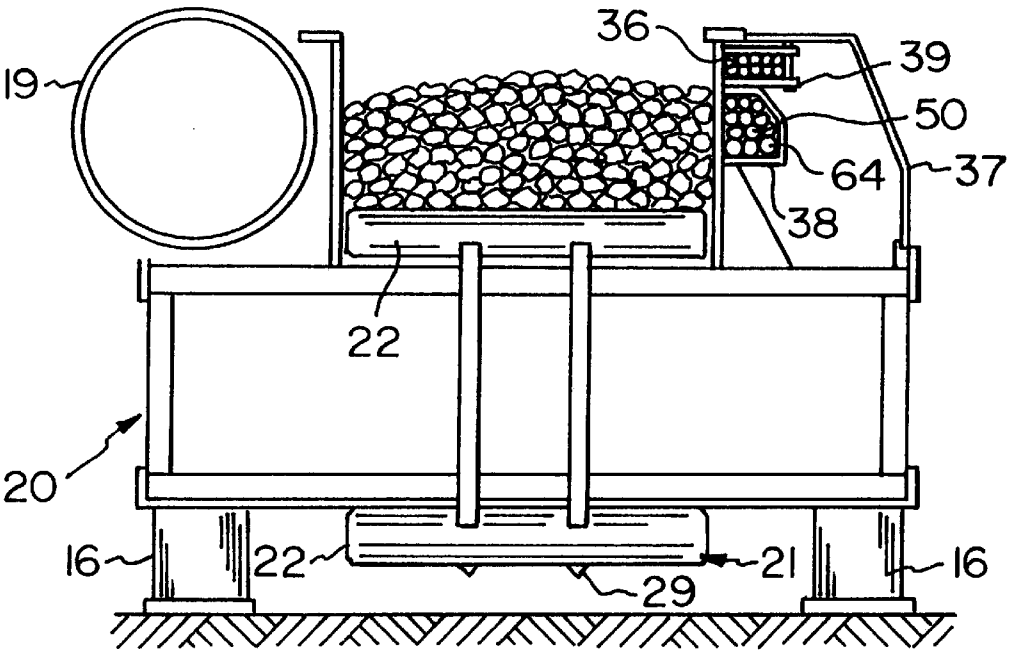
FIG. 6 is a vertical section through the tramming conveyor in the conveying mode.
Figure 7:
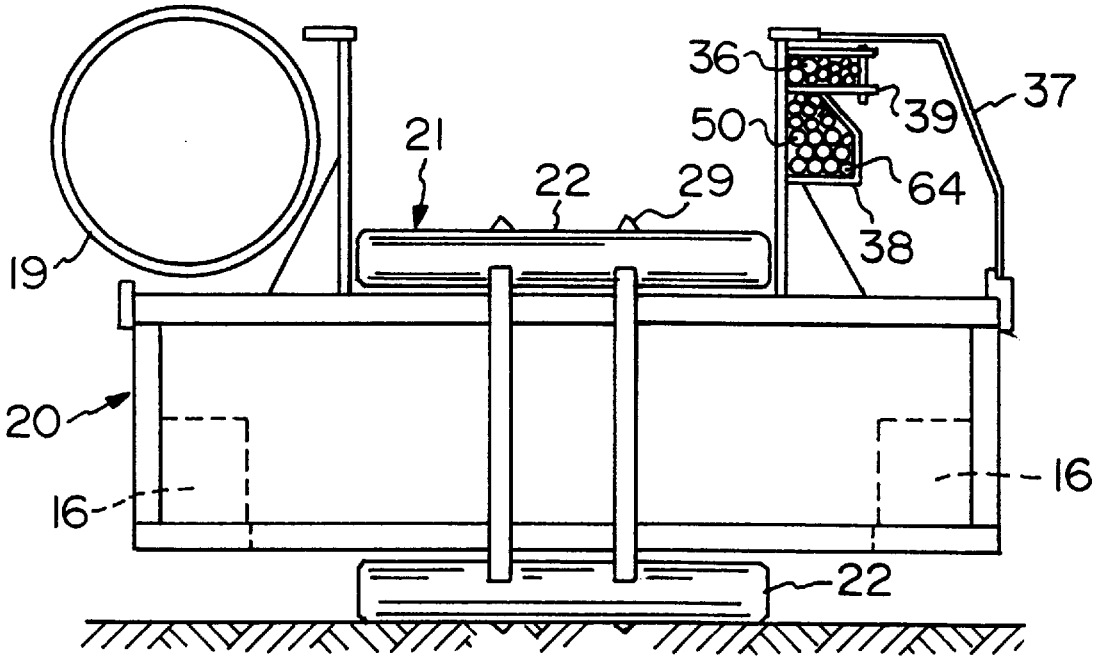
FIG. 7 is a vertical section through the tramming conveyor in the tramming mode.

Power cable bundle 50, the data communication cable bundle 36 and cooling fluid conduits 64 are shown in FIGS. 6 and 7 of the drawings as passing, respectively, through support and clamping brackets 38 and 39 located within housings 37 on tramming conveyor 20 to protect the cables and conduits from accidentally being cut as mining progresses.

Figure 8:
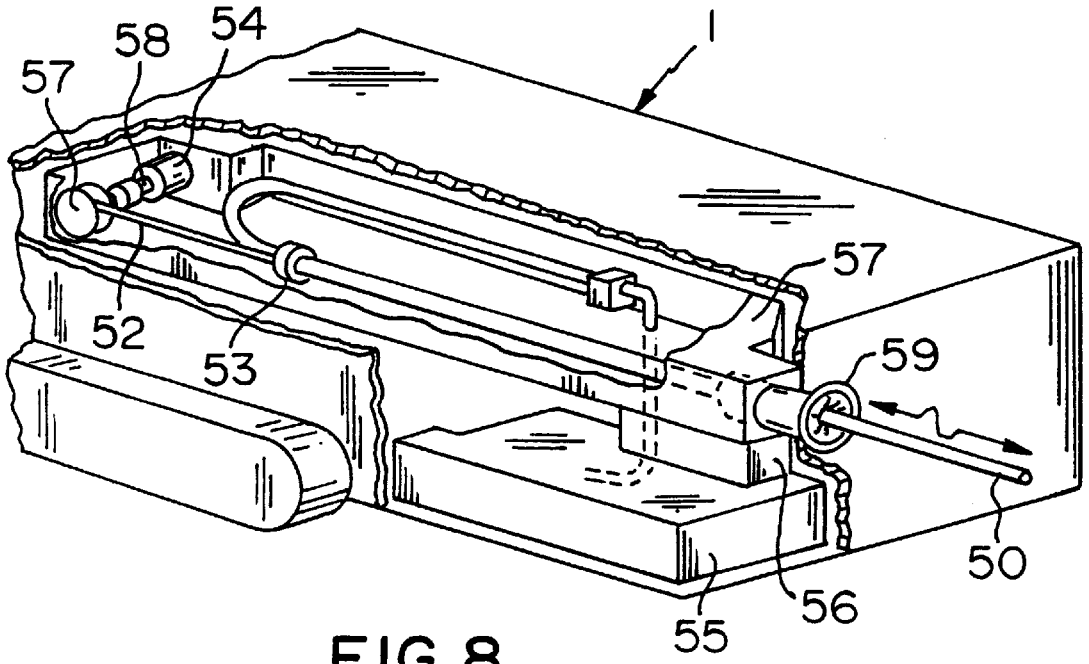
FIG. 8 is a broken perspective of a rear corner of the continuous miner.

The end of power cable bundle 50 opposite cable reeler 34 extends into a coffin box 51 located on the left rear corner of continuous miner 1 above a water cooled electrical control housing 55 as shown in FIG. 8 of the drawings. The power cable follows a U-shaped path in the coffin box returning toward the rear end of the continuous miner where it is directed downwardly through a chimney 56 into control housing 55 for connection to the controls for the continuous miner. The chimney has removable side panels to provide access to the power cable terminals located therein. The portion of power cable 50 located within coffin box 51 is attached to one end of an inelastic tension wire 52 by a retaining collar 53. The other end of inelastic tension wire 52 is connected to a take-up reel 57 mounted on a drive shaft 58. Tension on wire 52 is maintained by a constant torque hydraulic motor 54 which drives shaft 58 of take-up reel 57. The tension on wire 52 is transmitted to the end portion of power cable bundle 50 to prevent the power cable from lying on the ground between continuous miner 1 and tramming conveyor 20 where it could be cut during movement of the tramming conveyor. The entry opening into coffin box 51 is provided with an elastic seal 59 to prevent dust and dirt from entering the coffin box.

Figure 11:
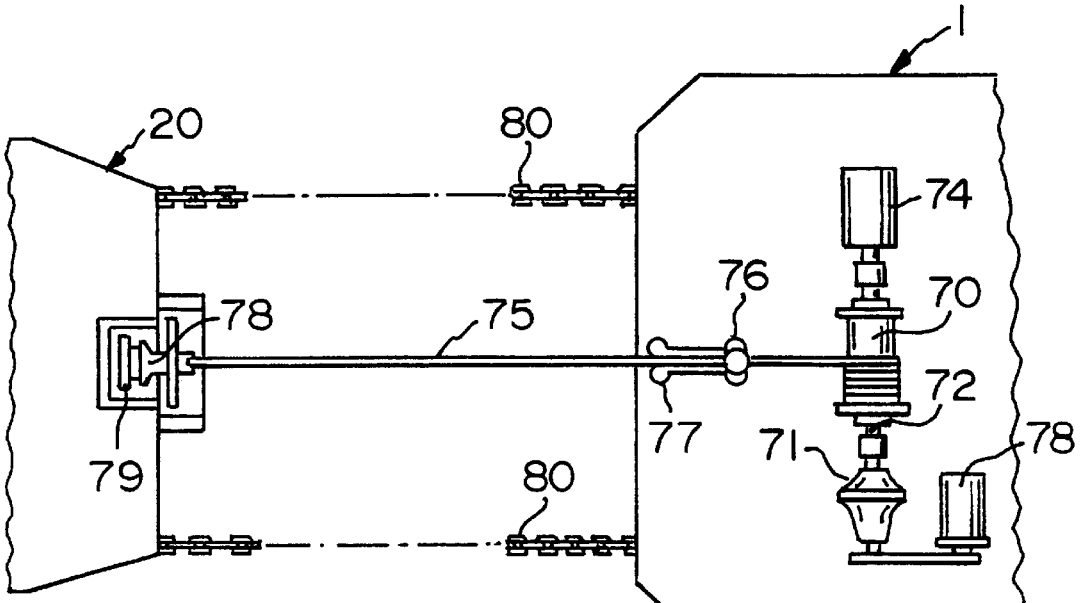
FIG. 11 is a schematic plan of the connections between the rear end of the continuous miner and the inby end of the tramming conveyor.
Figure 12:
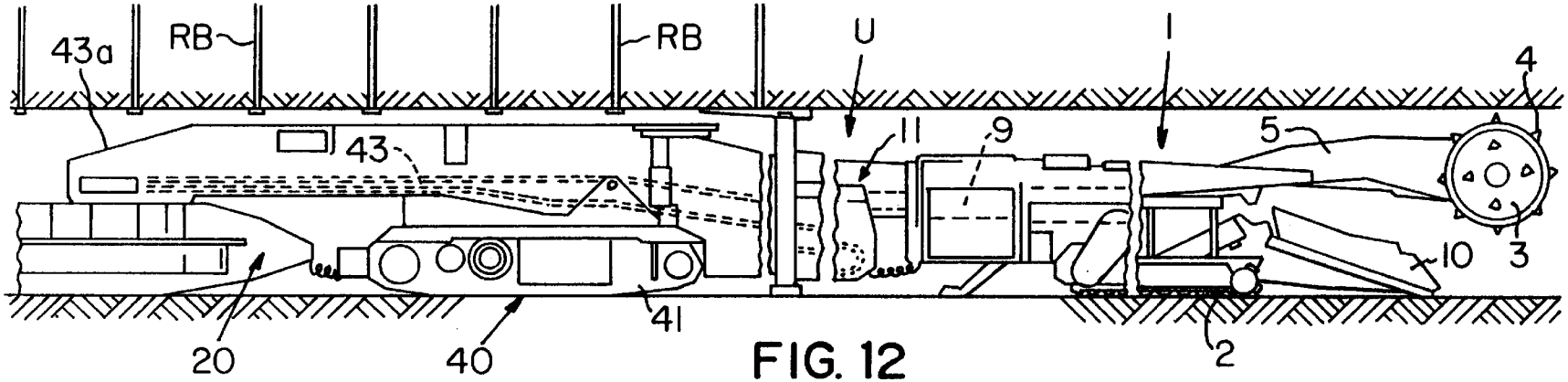
FIG. 12 is a schematic elevation of a portion of an underground mining system, including a roof bolting machine, and in accordance with the present invention.

FIG. 11 of the drawings shows a distance measuring arrangement extending between the rear end of continuous miner 1 and the inby end of tramming conveyor 20. Additionally, tramming conveyor 20 is steered from the continuous miner to maintain the desired angle between the discharge conveyor boom on the continuous miner and the tramming conveyor. The continuous miner carries a rotatable drum 70 which is connected to a speed reducer 71 by a rotary shaft 72 which is driven by a hydraulic motor 73. A distance measuring motor or rotary encoder 74 is also supported on rotary shaft 72. A wire rope 75 extends from drum 70 through a dashpot indicator 76 which is in alignment with the pivot for conveyor boom 11 to determine the angle of conveyor boom 11 relative to the tramming conveyor. Wire rope 75 also extends through vertical and horizontal wire rope guides 76 and horizontal pivoting guides 77 which are mounted on an arm extending from the dashpot. The signals from the dashpot are transmitted to the controls in the cab of the load-out vehicle.

The opposite end of wire rope 75 is connected to a microswitch 79 on tramming conveyor 20 by a toggle block 78 to control steering hydraulic cylinders (not shown) for the tramming conveyor. Thus, the length of wire rope 75 controls the distance between the rear end of continuous miner 1 and the inby end of tramming conveyor 20. A pair of safety chains 80 are connected between the rear end of continuous miner 1 and the inby end of tramming conveyor 20 to insure that the gap between the rear of the continuous miner and the tramming conveyor does not exceed a preset distance which would result in broken cables and conduits.

Figure 9:
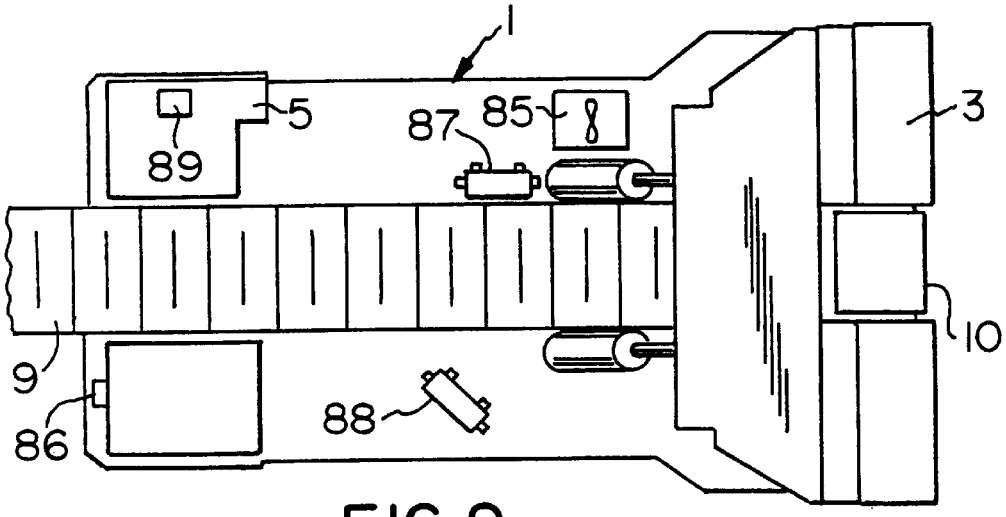
FIG. 9 is a schematic plan of the continuous miner.
Figure 10:
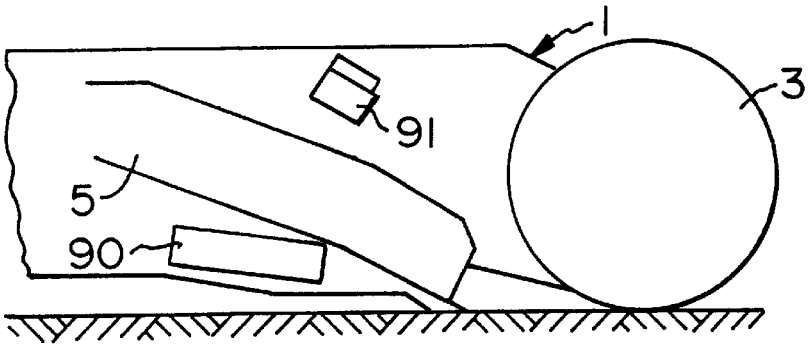
FIG. 10 is a schematic elevation of one side of the front end of the continuous miner showing gamma ray sensors.

FIG. 9 of the drawings shows the continuous miner with an onboard exhaust fan 85 for exhausting dust and methane from the area adjacent to the coal face. Ventilation air passes to continuous miner 1 through the ventilation tube 19 and control box 55 is shown at the left-hand rear corner of the continuous miner. A radio receiver 86 is shown at the rear of the continuous miner and heat exchangers 87 and 88 for the continuous miner hydraulic system are located forwardly of the control housing. The control box includes a temperature measurement device 89 to ensure that the temperature does not exceed a preselected maximum.

FIGS. 12, 13, 14 and 15 of the drawings show an embodiment of the mining system U for use in underground mining. The basic difference between the mining system used in highwall applications and the system used in underground mining is that the underground mining system includes a roof bolting machine 40 which is located between the rear end of continuous miner 1 and the inby end of tramming conveyor 20. However, the mining system shown in FIGS. 12–14 can also be used in an underground mine without the roof bolting machine 40, as described hereinafter. The roof bolting machine is required by safety regulations which specify that the roof be bolted with spaced roof bolts RB as the continuous miner progresses into the tunnel following the coal seam to prevent roof fall. Roof bolting machine 40 has a frame which supports crawlers 41. The roof bolting machine requires two workers for drilling bolt holes and setting the bolts RB as the roof bolting machine progresses into the mine tunnel behind continuous miner 1. As explained hereinafter, the roof bolting machine has independent controls to control the position of the roof bolting machine relative to the rear end of continuous miner 1 and the inby end of the tramming conveyor. The distance between the forward end of roof bolting machine 40 and continuous miner 1 will be determined by the length of the conveyor boom 11 on continuous miner 1 so that the mined coal is transferred from the continuous miner central discharge conveyor 9 onto a centrally located roof bolting machine conveyor 43 without spillage. Similarly, the distance between the roof bolting machine 40 and the inby end of the tramming conveyor will be determined so that the conveyor boom 43*a* on the roof bolting machine 40 transfers mined coal to the tramming conveyor without spillage. The mined coal is deposited on the inlet end of tramming conveyor 20 in the hopper section 24 by conveyor 43.

Figure 13:
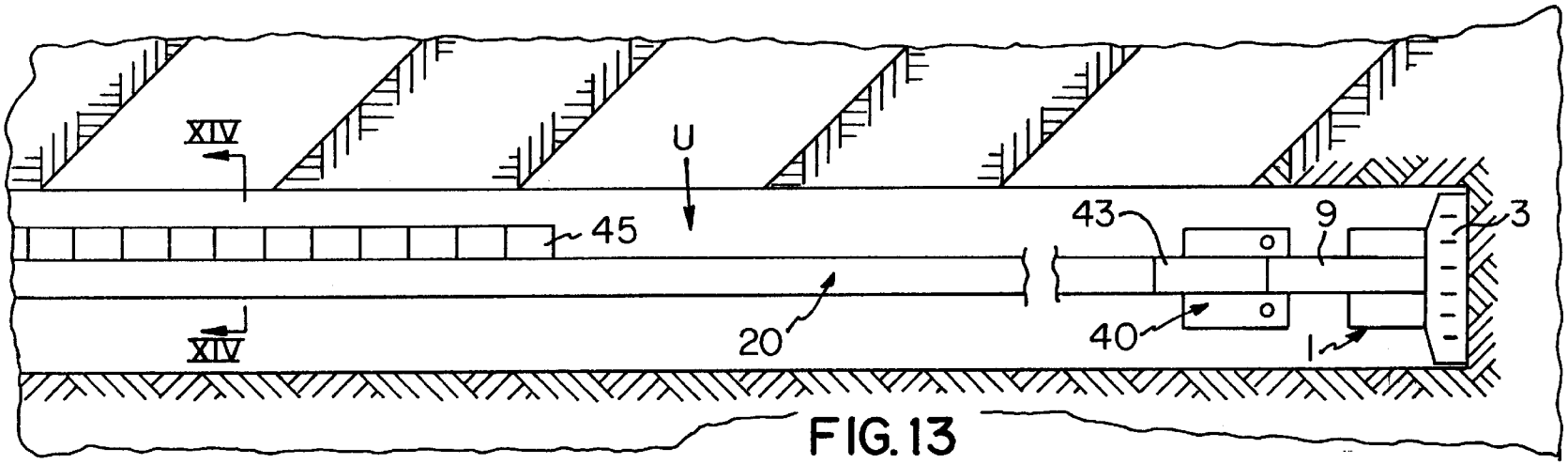
FIG. 13 is a broken schematic plan of a portion of the underground mining system shown in FIG. 12.
Figure 14:
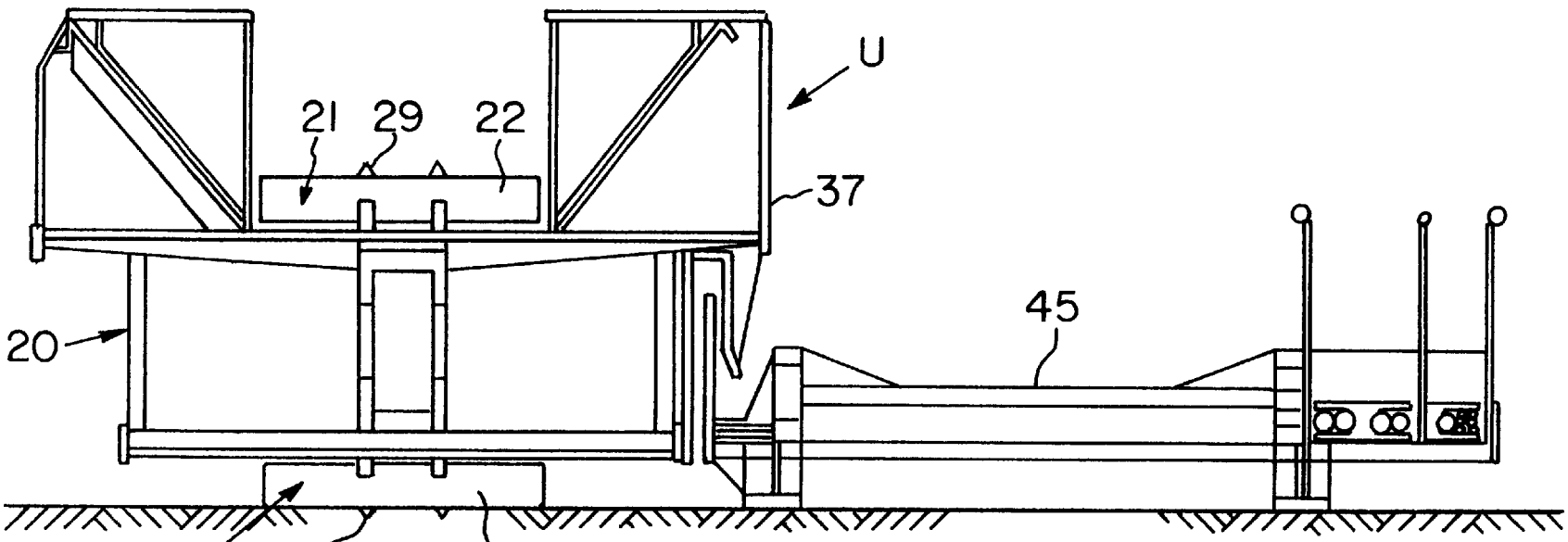
FIG. 14 is a section along line XIV—XIV in FIG. 13.
Figure 15:
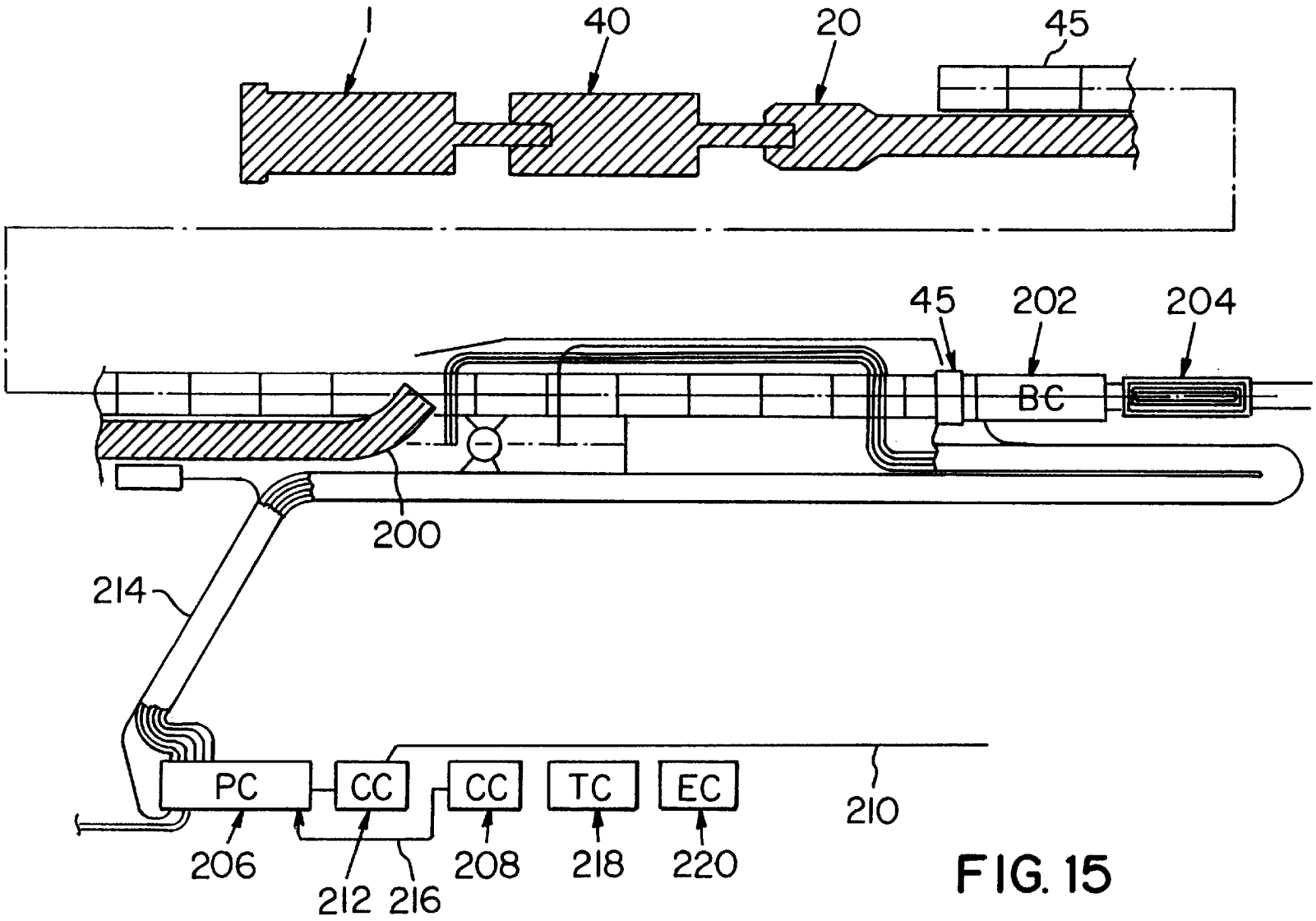
FIG. 15 is a schematic plan view of a complete underground mining system in accordance with the present roof bolting machine.

In the underground system, the mined material passes along tramming conveyor 20 which is parallel with a stationary belt conveyor 45 for a portion of its length as shown in FIGS. 13 and 15 of the drawings and the coal is transferred from tramming conveyor 20 to stationary belt conveyor 45 by means of an angled transfer section 200. Conveyor 45 transports the mined coal to trucks or to a point of treatment such as a crusher. The tramming conveyor in the underground system has the same basic construction as the tramming conveyor in the highwall system and supports an elongated ventilation tube 19 having fans spaced along its length for moving air or an inert gas to the seam face. Various data communication cables, power cables, cooling conduits and other cables or conduits for operating the mining system and controlling and monitoring the operation thereof pass through housing 37.

Figure 16A:
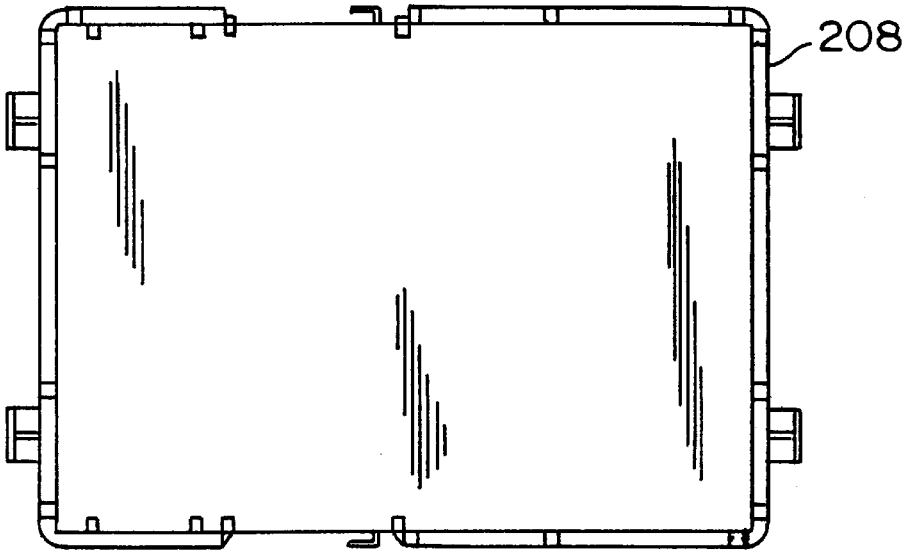
FIGS. 16A, 16B and 16C are top, side and end views, respectively, of the control cab shown in FIG. 15.
Figure 16B:
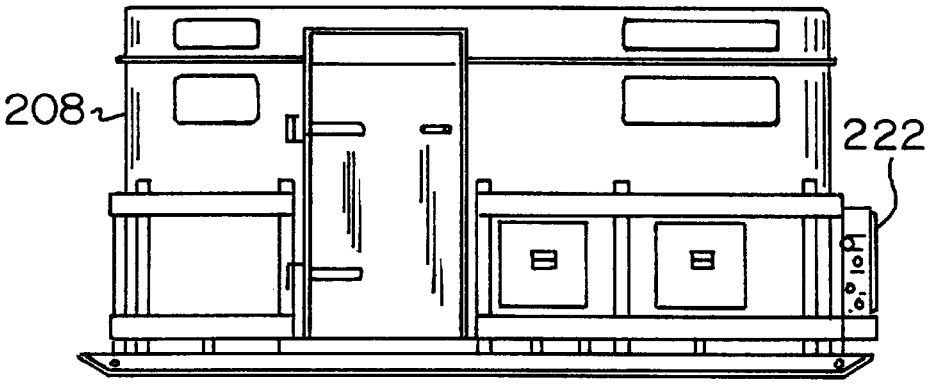
Figure 16C:
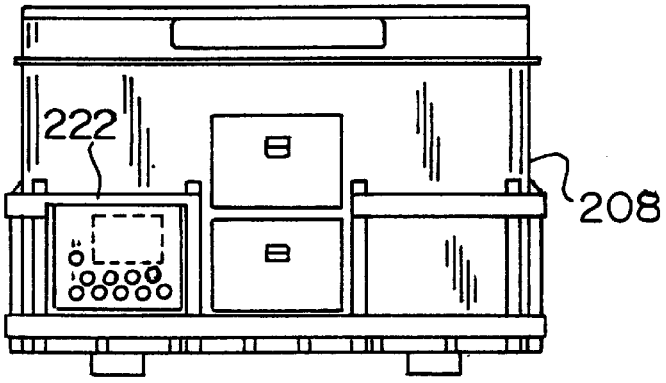

An overall underground mining system is shown in more detail in FIG. 15. The conveyor 45 may be a stage loader which can be increased in length by adding sections, as needed, as the mining continues and the tunnels lengthen. The conveyor 45 feeds to a breaker car 202 which supplies the broken coal to a belt structure sled 204 which removes the coal from the mine. Rather than using the load-out vehicle 30 at the outby end of the tramming conveyor 20, the tramming conveyor 20 conveys coal directly to the conveyor 45, and the power terminals and controls located in the load-out vehicle 30 as described above, can be placed in a power center 206 and a control cab 208 as shown in FIG. 15. Electrical power from a main power line 210 is supplied through a cable car 212 to the power center 206 and, through flexible and moveable cabling 214, to the underground mining system described above. Control signals to and from the control cab 208 pass through cabling 216 and the power center 206 to cabling 214. A tool car 218 and an emergency car 220 can be located underground and adjacent the control cab 208 and the power center 206. The control cab 208 is shown in more detail in FIGS. 16A–16C. The operator for the overall system, other than the operators for the roof bolter 40, will sit inside of the control cab 208 and control the overall operation of the underground miner system. Junction box 222 carries cabling 216 to and from the power center 206.

Figure 17:
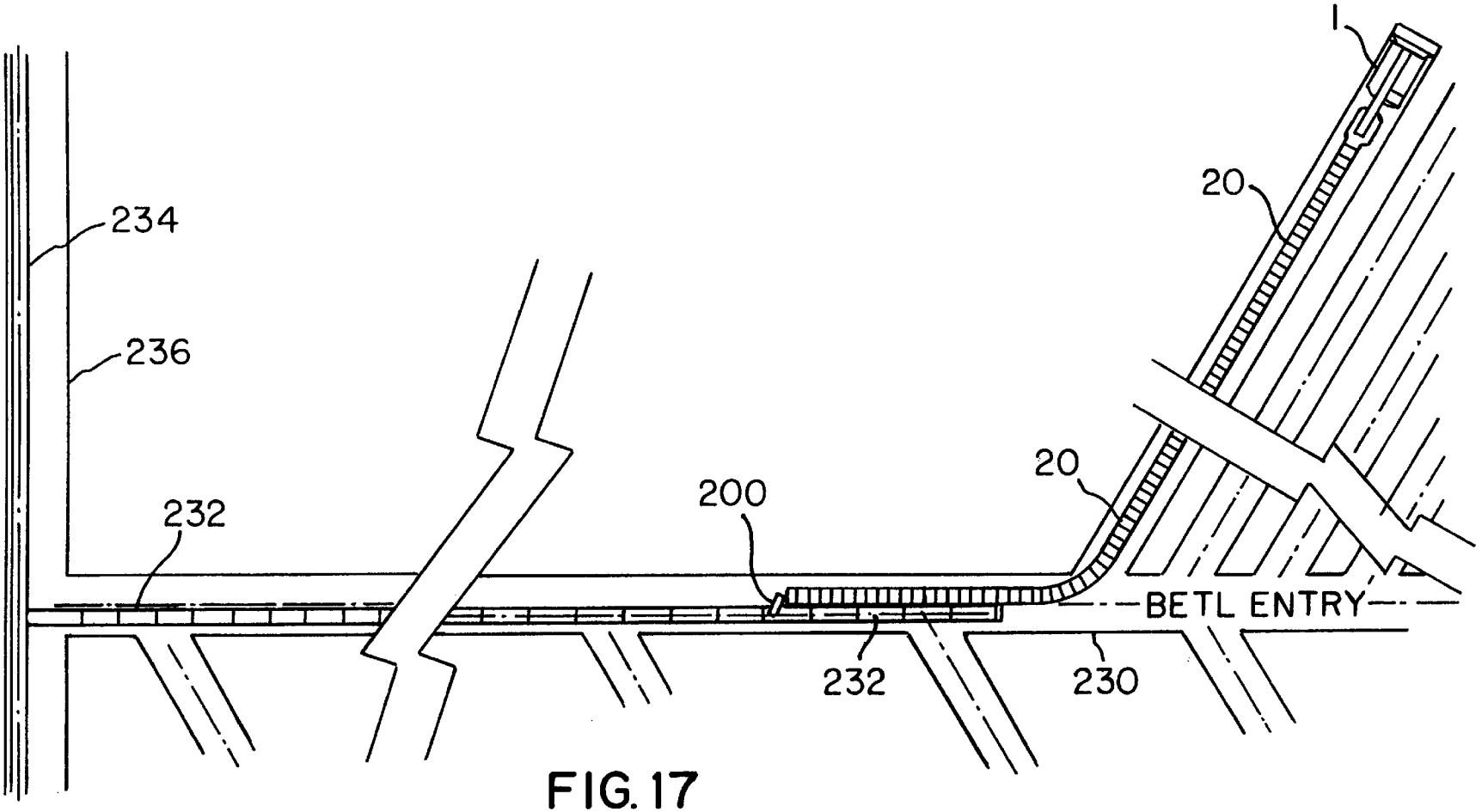
FIG. 17 is a schematic plan view of the underground mining system, but without the roof bolting machine, being used in a wing cutting operation.

The underground mining system described above in connection with FIGS. 12–16 is particularly suited for mining in passageways that need to have roof bolts installed. Such passageways are generally referred to as development passageways that will remain open and used for passage of mined coal, ventilation, transportation, or the like. The underground mining system can also be used, but without the roof bolting machine, in mining situations such as the wing cut design shown in FIG. 17, where the mined areas do not need supplemental roof support and the cuts are made at an angle between adjacent development passages. The miner 1/tramming conveyor 20 moves into the coal seam from the development passage 230 and begins to mine coal as described above. The mined coal is conveyed along the tramming conveyor 20 to a panel belt 232 in the development passageway 230, which then conveys the coal to a mother conveyor 234 in a main passageway 236. The length of the panel belt 232 is adjusted as needed so that the discharge end of the tramming conveyor 20 remains adjacent the panel belt 232 as the miner 1 advances into the face of the coal seam.

The connections shown between the miner 1 and conveyor 20 in FIGS. 8 and 11 would be provided between the rear of the miner 1 and the front of the roof bolting machine 40 as well as between the rear of the roof bolting machine 40 and the front of the conveyor 20 in the underground mining system described above. Typically, the distance between the miner and bolter car will vary between 1 foot to 6–8 feet and the distance between the bolter car and the conveyor will vary between 1 foot to 2–12 feet.

The automatic operation of the underground mining system, including the continuous miner, the roof bolting machine, the tramming conveyor, and the control cab, is controlled by a computer processor-based system distributed throughout the miner, the roof bolting machine, the tramming conveyor and the control cab. Additional arrangements are provided to enhance the operation, safety and reliability of the mining system. The control scheme and other elements in the mining system are based on the primary goal of recovering the system if something does go wrong while the continuous miner, the roof bolting machine, and the tramming conveyor are in a hole. Also, normal continuous operation of the mining system requires only a single operator in the control cab, which is located far from the mine face, and the operators of the roof bolting machine.

The automatic operation and computer control features of the present invention are illustrated in connection with FIGS. 18–22 of the drawings. From the initial formation of a hole in the coal or other mineral seam, the continuous miner is located in the hole and becomes progressively more difficult to reach if problems develop. As the continuous miner progresses into the coal seam, more and more of the tramming conveyor extends along the length of and is enclosed within hole. The control cab is always located out of the hole in a readily accessible location. The main focus of the control system of the present invention is to include redundancy where appropriate, to provide safety backups, and to physically locate the computers and control programs in appropriate areas. While the continuous miner has, as discussed hereinafter in more detail, its own computer physically located thereon for control of the miner and other aspects of the system, other computers are located in the control cab in normally accessible locations. Data communication between the computer on the continuous miner and the other computers is provided by a pair of parallel, hardwired data highways, referred to as a primary or first data highway 118 and a secondary backup data highway 120. In addition, a coaxial cable 122 extends from the control cab, along the tramming conveyor, to a video camera (not shown) located on the forward portion of continuous miner 1. This coaxial cable 122 is normally used to provide the operator in the load-out vehicle with a means for visually inspecting the mining operation. As discussed hereinafter in more detail, if either of the first or second data highways 118 or 120 fail, radio control signals can be sent into the hole and propagate along coaxial cable 122, which provides a transmission path to a radio receiver 86 on the continuous miner. The physical location of radio receiver 86 on the continuous miner is shown in FIG. 9. This additional backup data communication system permits the use of a hand-held radio controller for providing manual control signals to the mining system.

Figure 18A:
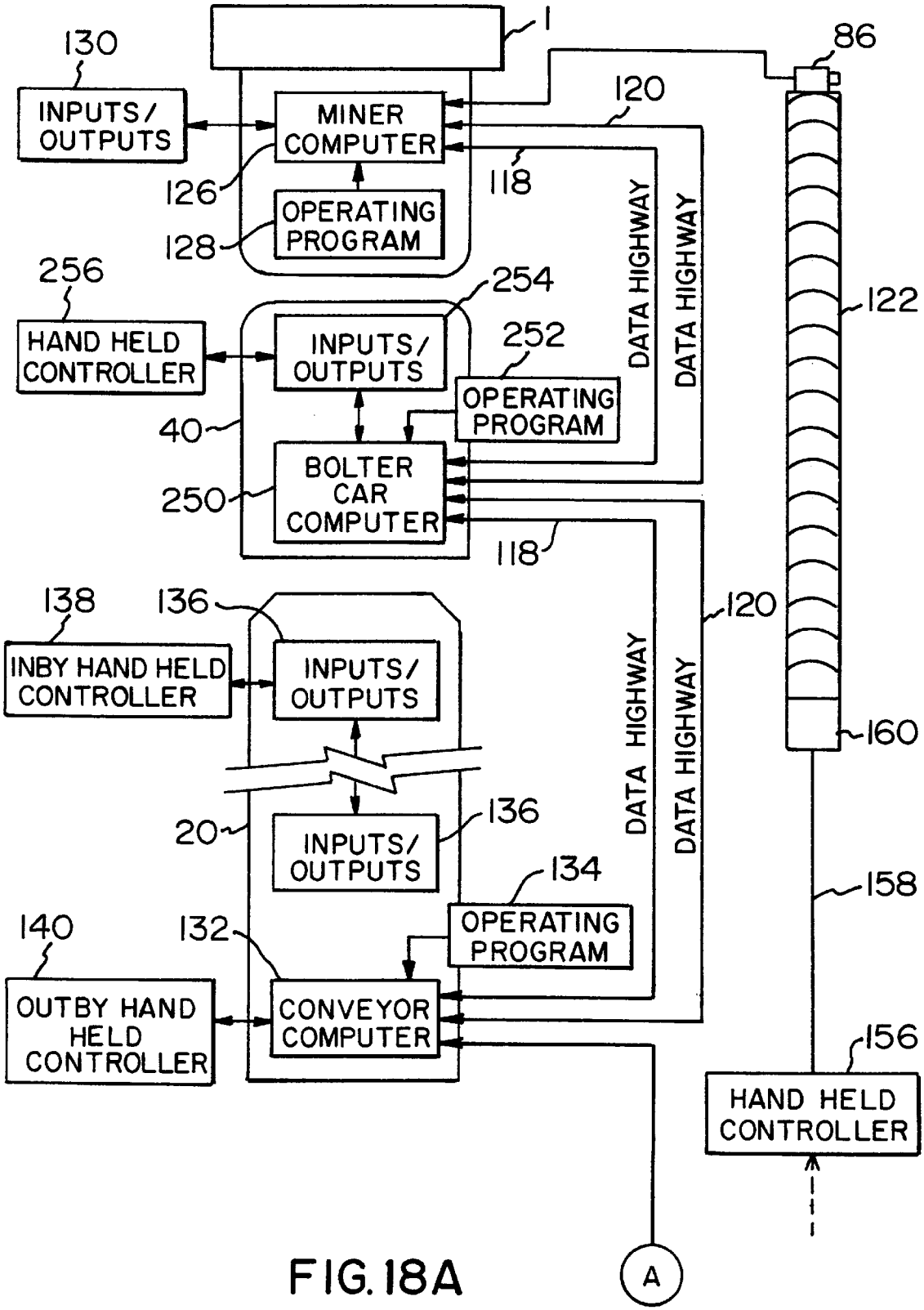
FIG. 18 is a schematic diagram of the computer control and data communication highway portions of the underground mining system.
Figure 18B:
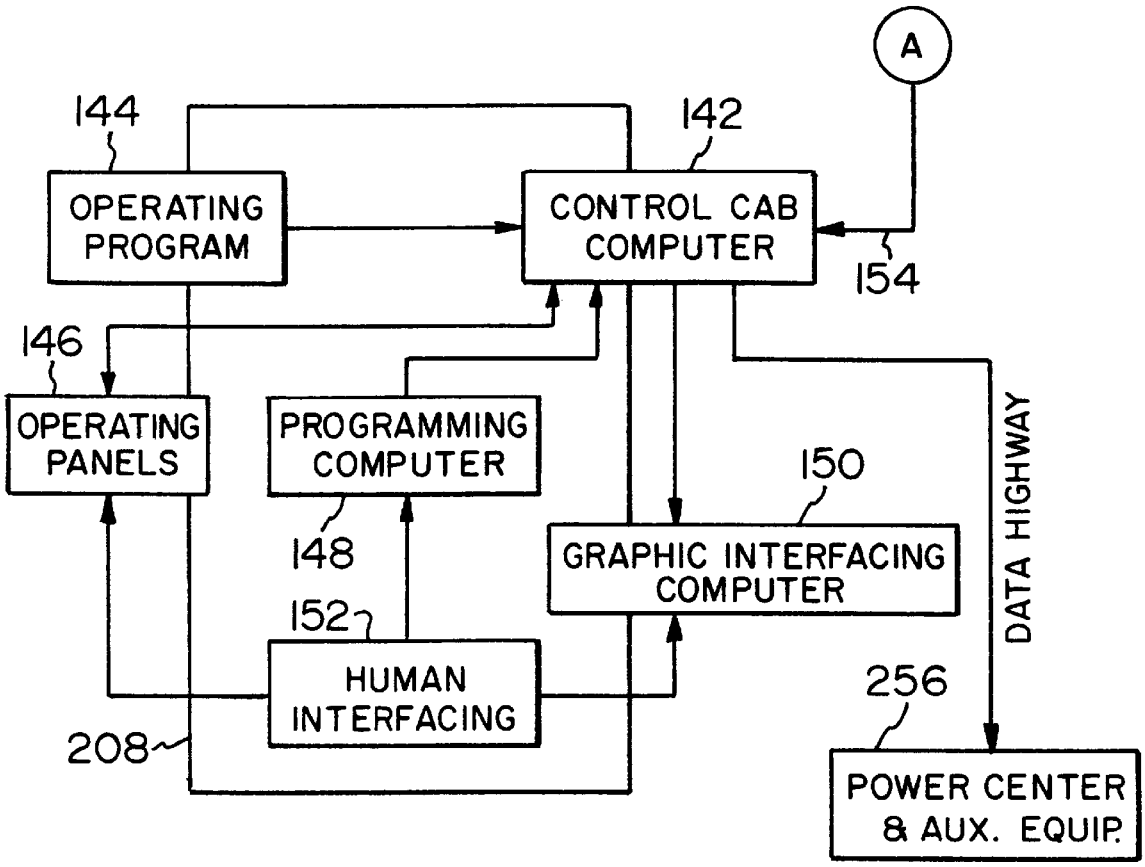

The arrangement of the computers and data flow paths of the overall system is shown in FIG. 18 of the drawings. The continuous miner has a miner computer 126 along with a stored operating program 128 for miner computer 126 located thereon. Miner computer 126 is used to control a number of inputs and outputs 130 associated with the continuous miner. The tramming conveyor also includes a conveyor computer 132 along with an associated operating program 134. Similar to miner computer 126, conveyor computer 132 controls a number of inputs and outputs 136 along the length of tramming conveyor 20. An inby hand-held controller 138 can provide direct, manual control of the inputs and outputs 136 on the tramming conveyor, and an outby hand-held controller 140 can communicate with the conveyor computer 132 and provide manual control of the inputs and outputs 136 on the tramming conveyor. The roof bolting machine or bolter car has a bolter car computer 250 and associated operating program 252 which controls certain inputs/outputs 254 in connection with the bolter car. A hand-held controller 256 provides direct, manual control of the inputs/outputs 252 on the bolter car. In particular, the bolter car will not be permitted to tram forward, as determined by the forward movement of the miner and spacing therebetween, until the operator of the bolter car provides a control signal, through controls 256 or the like, that the roof bolting has been completed. The first or primary data highway 118 extends between miner computer 126 and bolter car computer 250 and between bolter car computer 250 and conveyor computer 132. Similarly, the second or backup data highway 120 extends between miner computer 126 and bolter car computer 250 and between bolter car computer 250 and conveyor computer 132. Control cab 208 includes its own computer 142 along with an associated operating program 144.

The control cab 208 also includes operating panels 146, a programming computer 148 and a graphic interfacing computer 150, each receiving data from and/or supplying data to control cab computer 142. Operating panels 146, programming computer 148 and graphic interface computer 150 are controlled by a control cab operator or a computer technician referred to as "human interfacing" 152 in FIG. 14. The programming computer 148 is used only for initial programming of the operating programs (128, 134, 144 and 252) and computers (126, 132, 142 and 250) on continuous miner 1, tramming conveyor 20, and control cab 208 and bolter car 40 and is not used thereafter in controlling the normal operation of the mining system. Two-way data flow path 154 is provided between conveyor computer 132 and control cab computer 142. The data highway also extends from control cab computer 142 to the power center and various auxiliary equipment 256, but the data highway need not be redundant at this point. Since the control cab is under control of a human operator, through operating panels 146, a hand-held controller is not needed to control the control cab. However, hand-held controller 156, including extended antenna 158 and radio transmitter 160, provides optional control communication along coaxial cable 122 to radio receiver 86 located on the continuous miner as discussed above. Radio receiver 86 provides control signals directly to miner computer 126.

Figure 19A:
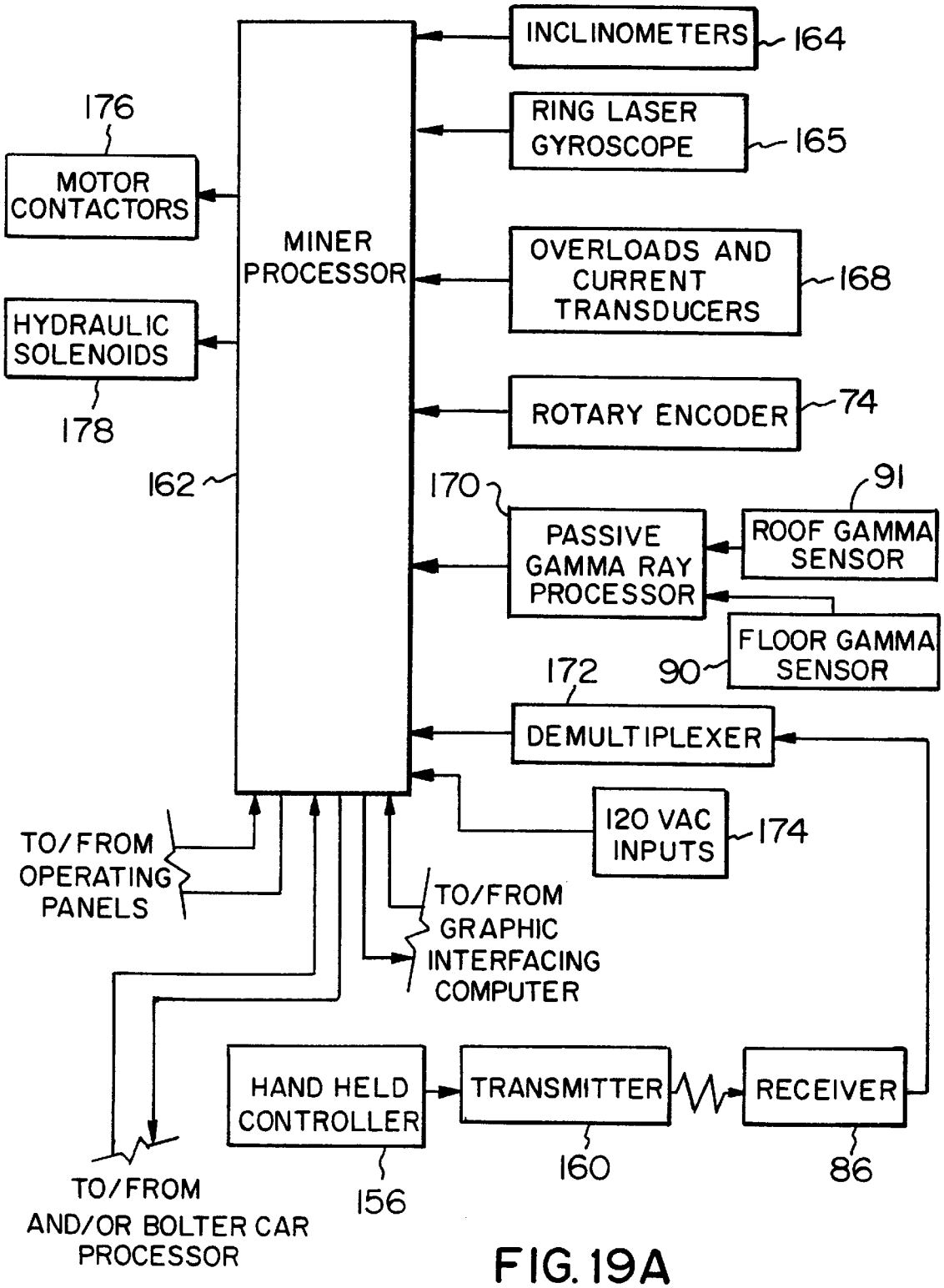
FIGS. 19A, 19B and 19C are block diagrams showing the details of the processors in the computer control system shown in FIG. 18.
Figure 19B:
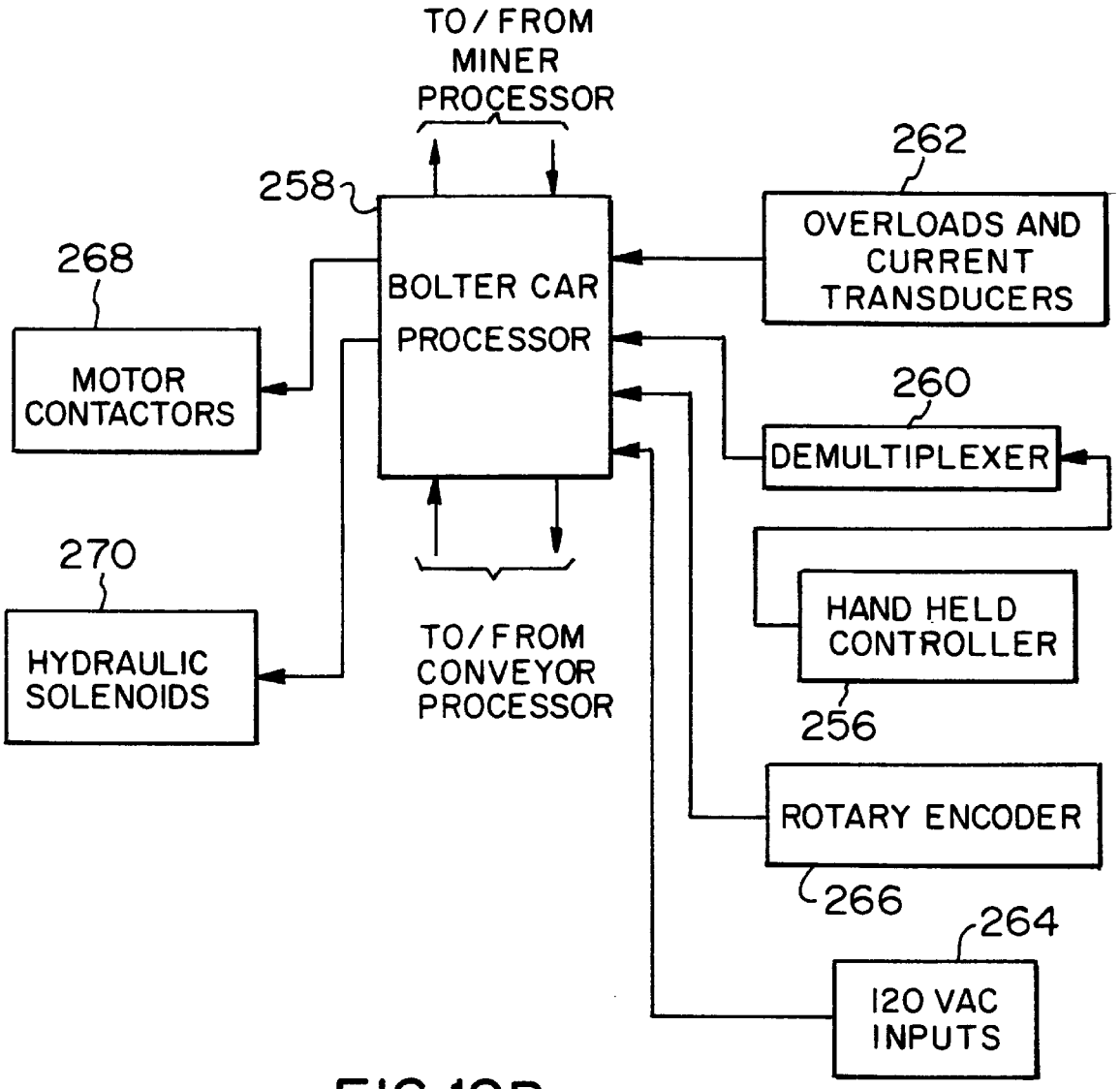
Figure 19C:
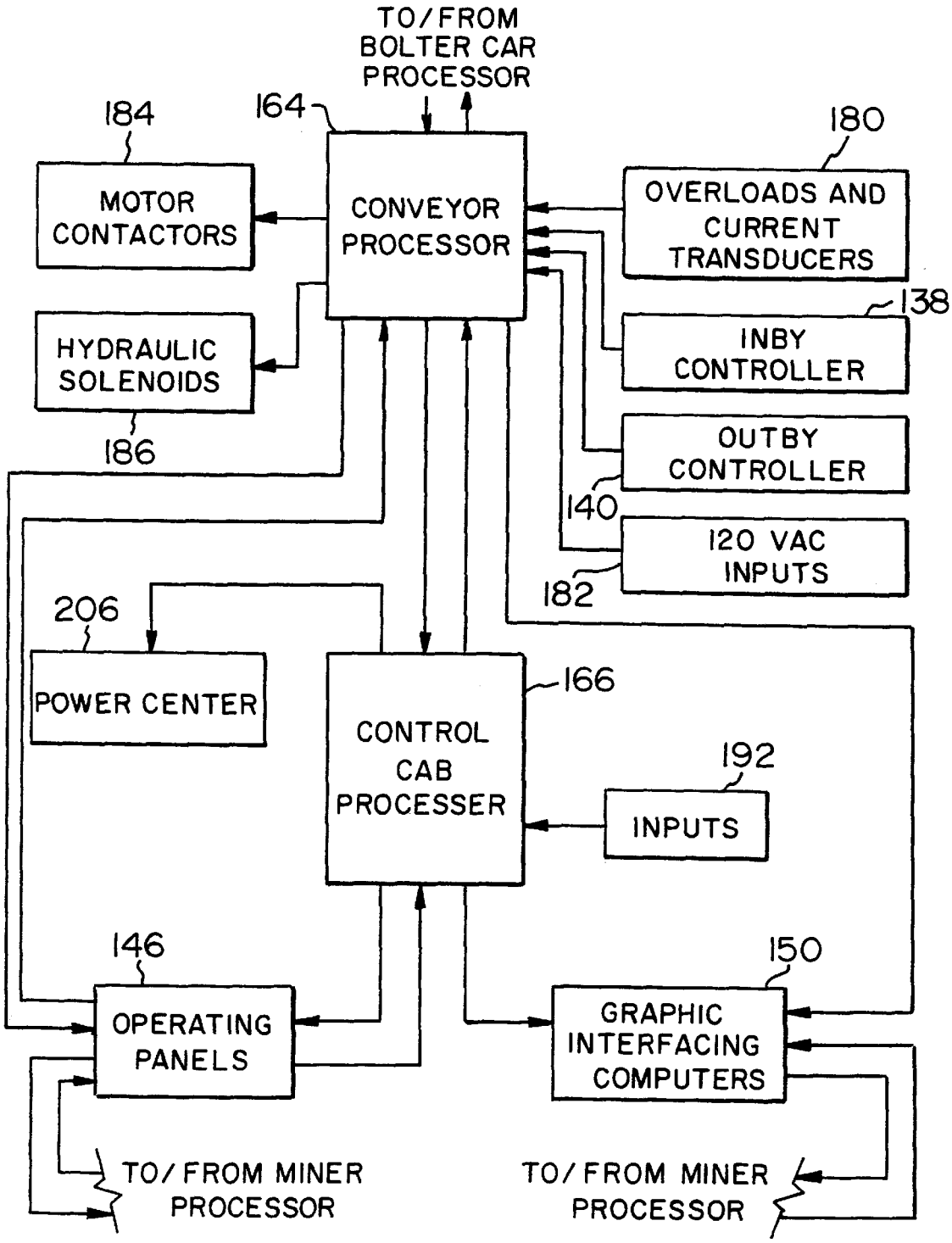

Details on the inputs supplied to and outputs controlled by miner computer 126, bolter car computer 250, conveyor computer 132 and control cab computer 142 are shown in FIGS. 19A, 19B and 19C of the drawings. For convenience, miner computer 126 and its associated operating program 128 shown in FIG. 18 are referred to collectively as a miner processor 162 in FIG. 19A. Similarly, bolter car computer 250 and its associated operating program 252 in FIG. 18 are referred to collectively as a bolter car processor 258 in FIG. 19B, conveyor computer 132 and its associated operating program 134 in FIG. 18 are referred to collectively as a conveyor processor 164 in FIG. 19C and control cab computer 142 and its associated operating program 144 are referred to collectively as a control cab processor 166 in FIG. 19C. Processors 162, 164, 166 and 258 can be Allen Bradley programmable logic controllers or other commercially available processors.

Referring to FIG. 19A, inclinometers 163 provide signals on relative machine position to miner processor 162. These inclinometers 163 provide readings on body pitch, body roll, cutter head, cutter head offset and gathering pan positions. Ring laser gyroscopes 165 mounted on the continuous miner provide azimuth and position signals to miner processor 162. Various overload sensors and current transducers 168 on the continuous miner provide information on the motor status to miner processor 162, including information on the cutter motors, gathering head motors, traction motors, hydraulic motor and ventilation fan motor. A rotary encoder or distance measuring motor 74 on the continuous miner provides a signal to miner processor 162 on the distance between the rear end of the continuous miner and the front or inby end of the bolter car. A roof gamma ray sensor 91 and a floor gamma ray sensor 90 provide signals to a passive gamma ray processor 170 which, in turn, provides signals on the location of the roof and the location of the floor to miner processor 162. These signals are used to keep the continuous miner properly positioned within the coal seam during normal operation. A radio receiver 86 on the continuous miner receives radio wave signals from transmitter 160 connected to hand-held controller 156 as described above. The radio wave signals received by the radio receiver are processed by a demultiplexer 172 which supplies control signals to miner processor 162. Various 120 volt AC input signals 174, also referred to as housekeeping signals from the continuous miner, are supplied to miner processor 162 to give information on emergency stops, machine status and the like. The continuous miner also receives information from the bolter car processor 258, operating panels 146 and graphic interface computer 150.

As a result of all of the information supplied to miner processor 162 and in accordance with the program stored therein, output signals are supplied to various motor contactors 176 and hydraulic solenoids 178 on the continuous miner. The motor contactors 176 supply electrical power to and control cutter motors, miner conveyor motors, miner tram motors, a hydraulic motor and ventilation fan motors along tube 19. Hydraulic solenoids 178 supply hydraulic fluid to and control the cutter head, gathering head, conveyor boom and stab shoe. In addition, miner processor 162 supplies data to conveyor processor 164 as well as to operating panels 146 and to graphic interface computer 150.

Referring now to FIG. 19B of the drawings, bolter car processor 258 receives signals from hand-held controller 256 through a demultiplexer 260, receives signals from various overload sensors and current transducers 262 on bolter car motor status, and various 120 volt AC input signals 264. Rotary encoder 266 on the bolter car, similar to rotary encoder 74 on the miner, provides a signal to the bolter car processor 258 on the distance between the rear or outby end of the bolter car and the front or inby end of the tramming conveyor. As a result of all of the information supplied to the bolter car processor 258, and in accordance with the program stored therein, output signals are supplied to various motor contactors 268 and hydraulic solenoids 270 on the bolter car. The bolter car processor also supplies signals to and receives signals from the miner processor 162 and the conveyor processor 164.

Referring now to FIG. 19C of the drawings, conveyor processor 164 receives signals from overload sensors and from current transducers 180 which reflect the status of the drive motors and ventilation fan motors along the length of tramming conveyor 20. In addition, when operating in a manual mode, conveyor processor 164 receives and responds to control signals from inby hand-held controller 138 or outby hand-held controller 140. Various 120 volt AC inputs 182, referred to as housekeeping signals from the conveyor, supply information on emergency stops, machine status and the like to the conveyor processor. Conveyor processor 164 also receives information from the bolter car processor 258, operating panels 146 and control cab processor 166.

As a result of all of the information supplied to conveyor processor 164 and in accordance with the program stored therein, output signals are supplied to various motor contactors 184, which supply electrical power to and control the drive motors and ventilation fan motors along the length of the tramming conveyor. In addition, conveyor processor 164 supplies output signals to hydraulic solenoids 186 which supply hydraulic fluid to control the steering pistons, a transmission shift, and hydraulic jacks 16 located along the length of tramming conveyor 20. Also, conveyor processor 164 supplies control signals to the bolter car processor 258, graphic interface computer 150, control cab processor 166 and operating panels 146.

With continued reference to FIG. 19C of the drawings, control cab processor 166 receives various 120 volt AC input signals 192, also referred to as housekeeping signals, from the control cab. Control cab processor 166 also receives control signals from conveyor processor 164 and, through the operating panels 146, from miner processor 162. As a result of these signals and the program stored therein, control cab processor 166 generates output signals which are supplied to the conveyor processor 164 and to the power center 256. Control cab processor 166 also supplies control signals to operating panels 146 and to graphic interface computer 150.

With the processor arrangement described above, the mining system of the invention, including the continuous miner, bolter car, tramming conveyor and control cab, can be used to mine coal and move the mining equipment along a hole or back out of the hole in accordance with one or more various modes of operation, as dictated by either the human operator or by certain automatic controls. In the automatic mining mode of operation, which is the intended normal operation of the system, the continuous miner will continuously move along the coal seam in a particular path and convey the mined coal to the bolter car, which moves the coal to the tramming conveyor which will, in the conveying mode of operation, move the coal along the length of the hole to a load-out area. The distance measuring step motor or rotary encoder 266 on the bolter car will continuously indicate the spacing between the rear end of the bolter car miner and the inby end of the tramming conveyor. When the spacing becomes too great, the tramming conveyor shifts to the tramming mode of operation wherein the conveyor stops moving coal and trams the conveyor toward the rear end of the bolter car to a preselected minimum distance therebetween, at which point the conveying mode commences. Similarly, the distance measuring step motor or rotary encoder 74 on the miner will continuously indicate the spacing between the rear end of the miner and the front end of the bolter car. When the spacing becomes too great, the miner stops moving coal and the bolter car moves toward the miner to a preselected minimum distance therebetween, provided that the bolter car operators have indicated through a manual control signal that roof bolting has been completed and that the bolter car can move forward.

Figure 20:
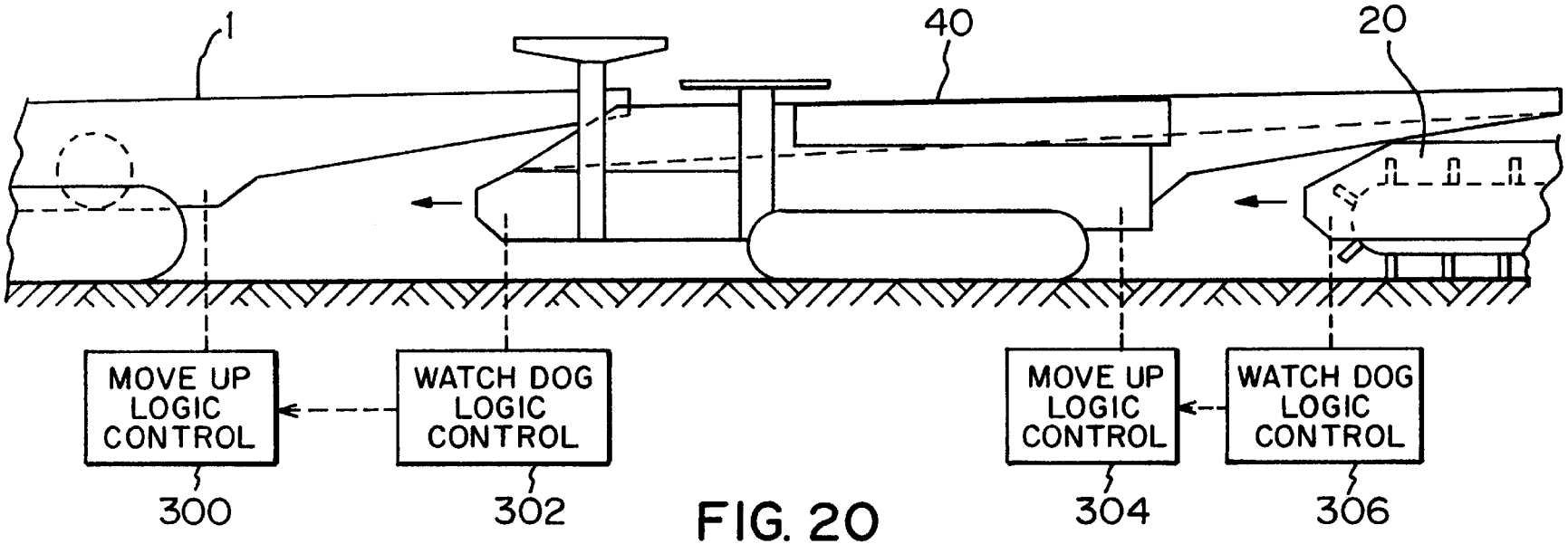
FIG. 20 is a schematic diagram of the miner/bolter car/tramming conveyor spacing controls.

Referring to FIG. 20 of the drawings, as certain move up logic 300 in miner processor 162 determines that the inby end of the bolter car 40 has reached a maximum preselected distance from the rear end of the continuous miner, miner processor 162 sends a control signal to bolter car processor 258 which initiates the steps discussed above of moving the bolter car forward. Watchdog logic 302 in bolter car processor 258 will double check the position information supplied from miner processor 162 to insure that the bolter car 40 does not run into the rear end of continuous miner 1, i.e., does not exceed the preselected minimum distance therebetween. Similarly, as certain move up logic 304 in bolter car processor 258 determines that the inby end of tramming conveyor 20 has reached a maximum preselected distance from the rear end of the bolter car, bolter car processor 258 sends a control signal to conveyor processor 164 which initiates the tramming mode of operation of the tramming conveyor. Watchdog logic 306 in conveyor processor 164 will double check the position information supplied from bolter car processor 258 to insure that tramming conveyor 20 does not run into the rear end of bolter car 40, i.e., does not exceed the preselected minimum distance therebetween.

Figure 21:
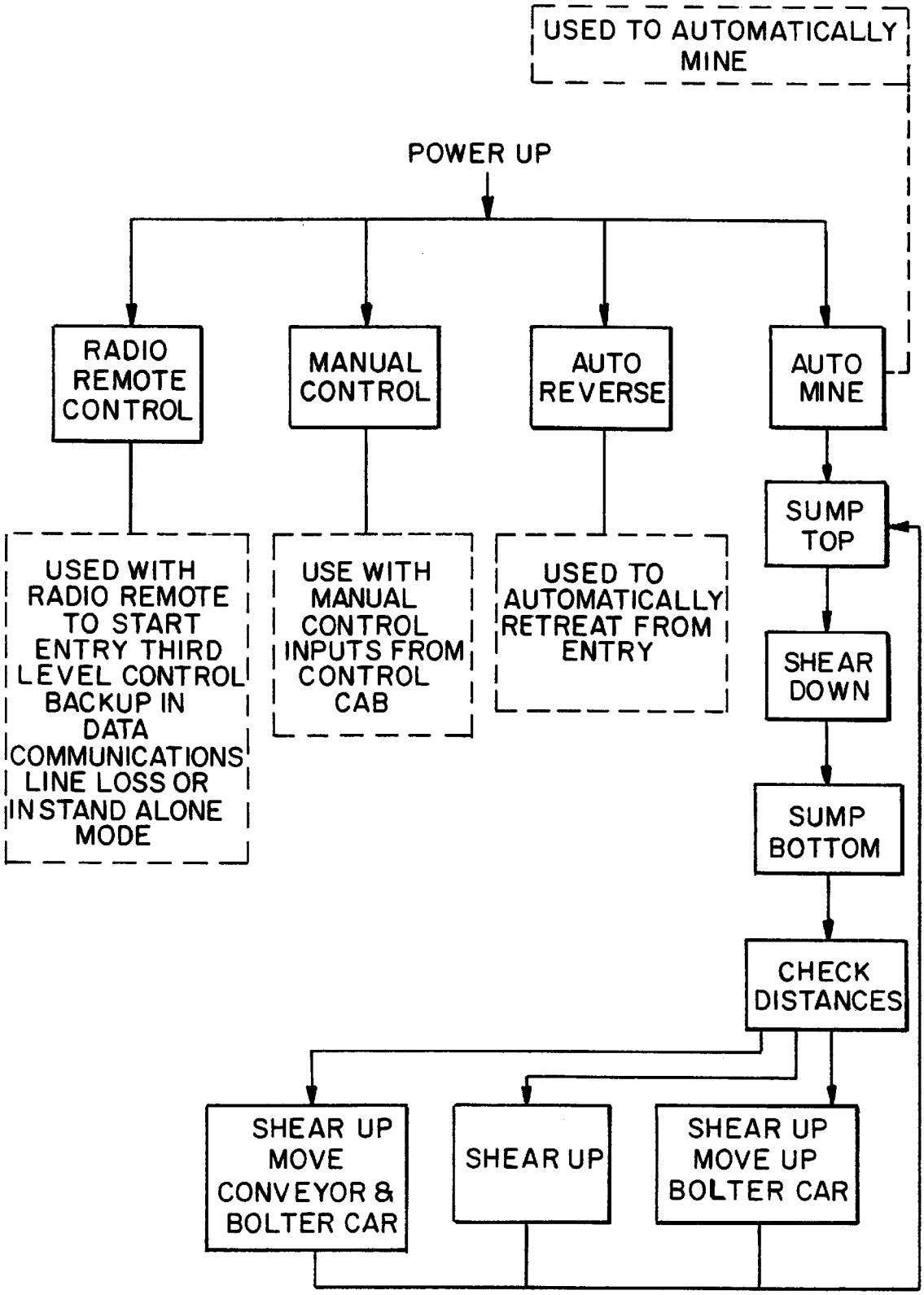
FIG. 21 is a flow diagram for the overall operation of the continuous miner processor.
Figure 22:
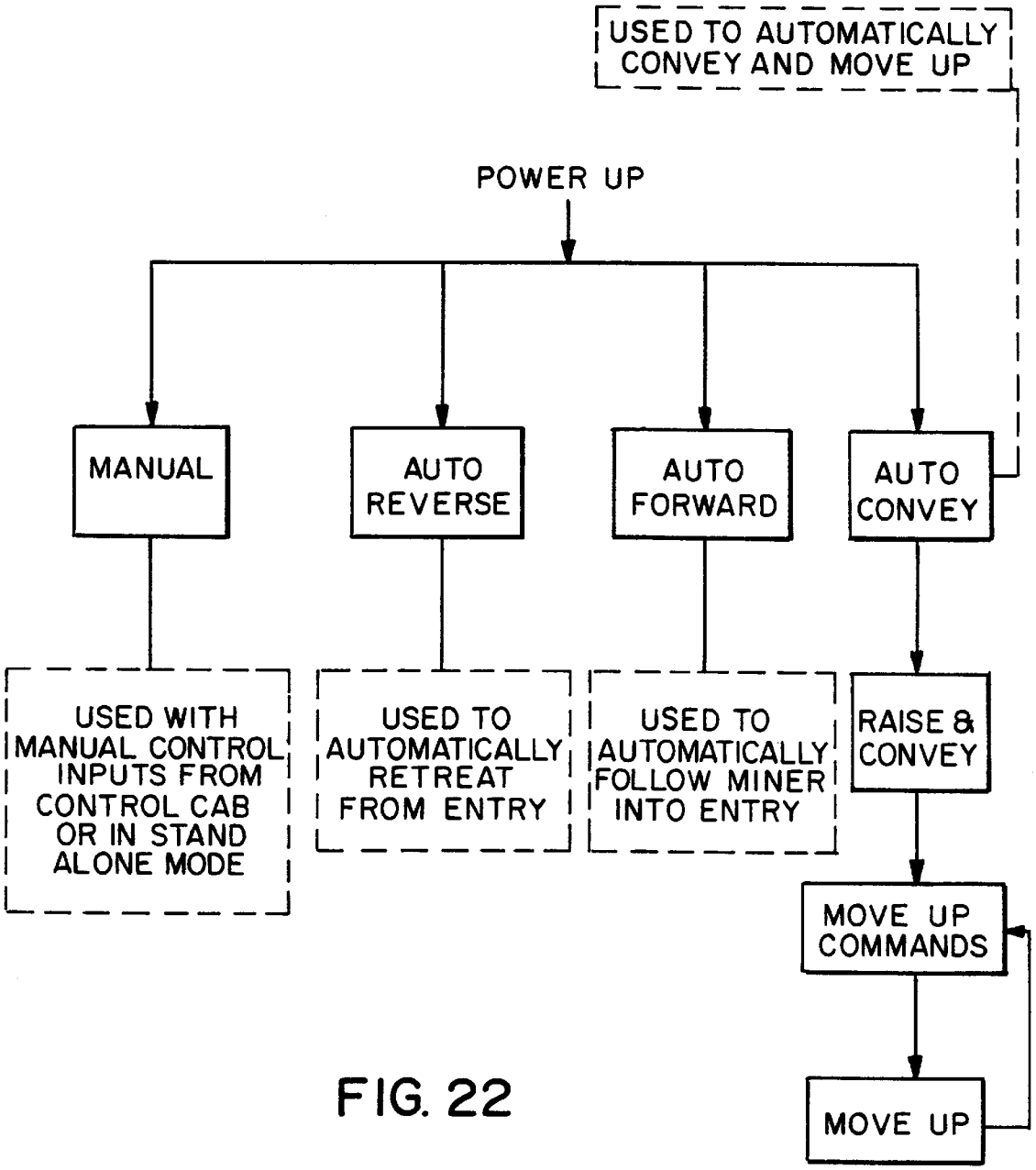
FIG. 22 is a flow diagram for the overall operation of the tramming conveyor and roof bolting machine processors.

The various modes of operation of miner processor 162, bolter car processor 258 and conveyor processor 164 are shown in the flowcharts of FIGS. 21 and 22, respectively. In the automatic mining or "auto mine" mode of operation, control signals supplied from inclinometers 163 and ring laser gyroscopes 165, as well as control parameters previously supplied from the operator on the control cab, will enable miner processor 162 to properly and automatically mine a coal seam and stay within the seam. Although the roof and floor gamma ray sensors 91 and 90 could be used to automatically mine the coal and ensure that the continuous miner stays within the seam, it is presently preferred to use the roof and floor gamma sensors 91 and 90 merely to provide information to the operator for making proper initial settings and interim modifications for overall operation. In this manner, the continuous miner cuts a smooth floor that is advantageous for subsequent operation of the tramming conveyor, rather than allowing the continuous miner to follow irregularities which occur in the boundary between the coal seam and strata in the roof and floor. As shown in FIG. 21 of the drawings, in the auto mine mode of operation, the continuous miner sumps in at the top of the seam, shears down, sumps in at the bottom of the seam, checks the distances between the miner and bolter car and between the bolter car and the tramming conveyor, and then either shears up, or both shears up and moves the bolter car forwardly, or both shears up and moves both the bolter car and the tramming conveyor, before returning to the initial step of sumping in at the top of the seam. However, it should be understood that the miner can be operated according to other sequences if desired.

Referring to FIG. 22 of the drawings in the "auto convey" mode of operation for conveyor processor 164, which is used when the continuous miner is in the "auto mine" mode of operation, conveyor processor 164 will, as primarily controlled by miner processor 162, send signals to extend the hydraulic cylinders in jacks 16 to raise the tramming conveyor above the mine floor to convey mined coal and the bolter car conveyor will also convey coal rearwardly. When conveyor processor 164 receives a particular command, as dictated by the spacing between the rear end of the bolter car and the inby end of tramming conveyor 20, which is detected by rotary encoder 266 on the bolter car, the conveyor on the continuous miner will stop conveying coal to the tramming conveyor for a defined period of time. The tramming conveyor will continue to convey coal rearwardly for a predetermined period of time sufficient to provide a clear area on the top of the chain in the tramming conveyor in the hopper section and hydraulic jacks 16 will be retracted to lower the tramming conveyor to the mine floor. A move-up command reverses the direction of operation of the chain in the tramming conveyor to tram the entire conveyor forwardly toward the rear end of the bolter car until a preset minimum spacing is achieved. Similarly, the bolter car will stop conveying coal and move forward toward the miner when the spacing therebetween exceeds a maximum distance. The steps of continuously mining, moving the continuous miner forward, conveying the mined coal, interrupting the conveying of coal from the continuous miner to the bolter car and to the tramming conveyor, tramming the tramming conveyor forwardly toward the rear end of the bolter car and/or moving the bolter car forward toward the miner and thereafter resuming conveyance of mined coal from the continuous miner are serially repeated as the entire mining system progresses into the hole.

Conveyor processor 164 can also operate bolter car and tramming conveyor 20 in an "auto forward" mode of operation as shown in FIG. 22 of the drawings. This mode of operation is used when the continuous miner is being advanced into an entry under manual control. In this mode of operation, the bolter car and tramming conveyor merely follow along behind the continuous miner at a preselected distance therefrom. The miner processor is operated in a manual control mode of operation (see FIG. 21) by manual control input signals from control cab. In addition, the tramming conveyor can be controlled in a manual control mode of operation, in a stand-alone mode or with manual control inputs from the load-out vehicle. In the stand-alone mode of operation, the tramming conveyor is controlled by outby hand-held controller 140 supplying control signals to conveyor computer 132, or by inby hand-held controller 138 which directly controls the inputs and outputs 136 on the tramming conveyor. Similarly, the bolter car can be manually controlled by hand-held controller 256.

Two additional and important modes of operation are provided for the continuous miner, bolter car and tramming conveyor in accordance with the invention. As described above, parallel data highways 118 and 120 are provided between miner computer 126 and conveyor computer 132 and through bolter car computer 250. Normal data communications are provided over primary data highway 118, although the system continuously monitors to determine that both data highways 118 and 120 are operating properly. If one of data highways 118 or 120 is lost, for any reason, miner processor 162, bolter car processor 258 and conveyor processor 164 are automatically switched to an automatic reverse mode of operation. In this mode of operation, all mining and conveying are stopped, and all systems are operated over the remaining, functional data highway to permit the mining system to be reversed. This reverse mode of operation, with all mining stopped, will occur if one of the data highways fails which indicates a problem under which normal mining operations relying on only the remaining data highway is not advisable. In this manner, it is possible to safely back the complete mining system out under either normal computer control or manual control so that inspection and repair can be made.

In the event that both data highways 118 and 120 fail, conveyor computer 132 and bolter car computer 250 are switched to a mode of operation completely controlled by miner computer 126 and miner computer 126 is switched to a radio remote controlled mode of operation. Under this control mode, the continuous miner, bolter car and tramming conveyor stop all normal operations and wait to receive control signals supplied from radio receiver 124 to miner computer 126. As described above, a hand-held controller 156 transmits radio control signals over coaxial cable 122 and these signals are propagated in the air toward the continuous miner, and received by radio receiver 86 on continuous miner 1. Miner computer 126 will then control the operation of continuous miner 1, bolter car 40 and tramming conveyor 20 as dictated by the control signals transmitted by hand-held controller 156.

Control cab processor 166 operates only in a manual mode of operation with panel and control cab inputs. The control cab processor 166 monitors all essential onboard functions and reports status data to the other processors and to graphic interface computer 150. Graphic interface computer 150 provides graphic man/machine interfacing for machine control. It displays status and operating screens and permits the operator to override programmed, calculated mining parameters to cover unusual situations. Operating panels 146 provide a means for the operator to supply desired mining parameters to miner processor 162 and to display the status of various operating functions. Miner processor 162 also monitors all essential onboard functions and reports status and position data to the other processors and to graphic interface computer 150. It also calculates all mining parameters and acts as the "master" controller when communicating to the other processors doping the automatic mining mode of operation. Conveyor processor 164 also monitors all essential onboard functions and reports status data to the other processors and to graphic interface computer 150. Conveyor processor 164 and bolter car processor 258 function as "slave" controllers to miner processor 162 except when it is operating in the manual or stand-alone modes of operation.

The mining process is started by a mechanic/electrician locating the continuous miner at the desired entry into the coal. After the continuous miner is in position, the operating technician in the control cab is advised by radio or the like that the system is ready to be controlled by the computer operation. The operating technician initiates the computer controls to fully automate the mining cycle. The computers are programmed to cut, load, and convey the mined coal automatically. The continuous miner automatically sumps in at the top of the seam, shears down, sumps in at the bottom of the seam and shears up in a continuous cycle. The miner is programmed to continue that cycle until it advances a preset distance from the inby end of the bolter car conveyor. When that preset distance is reached, the end discharge of the boom for discharge conveyor 9 on continuous miner 1 is located at the inby end of the conveyor on the bolter car. The bolter car is moved up close to the rear end of the continuous miner. Thereafter, the tramming conveyor is moved up close to the rear end of the bolter car. The mining cycle is then repeated until it is time to advance the bolter car and/or the tramming conveyor.

Mining navigation and coal quality are constantly monitored by gamma detectors 90 and 91, inclinometers 163 and gyroscope 165 on continuous miner 1. Data from these instruments are supplied to miner processor 162, as discussed above, where the data are analyzed. Miner processor 162 automatically signals continuous miner 1 if any adjustments are needed to keep the continuous miner in the seam and on azimuth.

While one embodiment of the invention is described in detail herein, it will be appreciated by those skilled in the art that various modifications and alternatives to the embodiment can be developed in light of the overall teachings of the disclosure. Accordingly, the particular arrangements are illustrative only and are not limiting as to the scope of the invention which is to be given the full breadth of the appended claims and any and all equivalents thereof.

We claim:

1. A method of controlling the operation of a continuous underground mining system including a continuous miner having a forward end with a cutting means and a rear end, a roof bolting machine having an a front end operatively connected to and trailing the rear end of the continuous miner, an articulated tramming conveyor having an inby end operatively connected to and trailing a rear end of said roof bolting machine, said tramming conveyor having an outby end spaced from its inby end, and a control cab operatively connected to and trailing said tramming conveyor, said method comprising the steps of:

a) providing a master computer processor on said continuous miner, b) providing at least one slave computer processor for controlling elements of said mining system other than said continuous miner, under the direction of said master computer processor, c) providing a pair of parallel data communication highways between said master computer processor and said slave computer processor, d) providing a radio communication path between said master computer processor and the outby end of said tramming conveyor, e) monitoring the functional status of said data communication highways, f) operating said mining system through said master computer processor in an automatic mining mode of operation when both of said data communication highways are functional, g) operating said mining system through said master computer processor in a reverse mode of operation if either of said data communication highways fails to function, whereby all mining operations cease and said mining system may be reversed out of a mine hole, and h) operating said mining system through said master computer processor in a manual, radio controlled mode of operation over said radio communication path if both data communication highways cease to function, whereby the master computer processor stops all automatic operations and is controlled solely by control signals over said radio communication path.

2. The method of claim 1 wherein said slave computer processor includes a conveyor computer processor located at said outby end of said tramming conveyor and a roof bolting machine computer processor located on said roof bolting machine.

3. The method of claim 2 wherein said parallel data communicator highways are a pair of data cables extending along the length of said tramming conveyor from the conveyor computer processor through the roof bolting machine computer processor and to said master computer processor.

4. The method of claim 1 wherein said radio communication path is a radio wave transmitting cable extending along the length of said tramming conveyor and a radio receiver on said continuous miner which is operatively connected to and supplies control signals to said master computer processor.

5. The method of claim 4 wherein said radio wave transmitting cable is a coaxial cable.

6. The method of claim 1 including:

i) controlling the sequential cutting operation of said cutting means on said continuous miner in a coal seam, said method including sumping said cutting means inwardly at the top of the coal seam, shearing said cutting means downwardly to the bottom of the coal seam, sumping said cutting means inwardly at the bottom of the coal seam, and shearing said cutting means upwardly to the top of the coal seam in continuous repetitive cutting cycles until said rear end of said continuous miner is spaced a predetermined maximum distance from said front end of said roof bolting machine and/or the rear end of said roof bolting machine is spaced a predetermined maximum distance from the inby end of the tramming conveyor, j) constantly measuring the distances between said rear end of said continuous miner and the front end of said roof bolting machine and between the rear end of the roof bolting machine and the inby end of the tramming conveyor, k) interrupting the operation of said cutting means on said front end of said continuous miner, l) lowering said tramming conveyor to the ground to tram said tramming conveyor toward said rear end of said roof bolting machine when said rear end of said roof bolting machine reaches said predetermined maximum distance from said inby end of said tramming conveyor until a predetermined minimum distance is measured therebetween and/or moving said roof bolting machine toward the rear end of said continuous miner when the front end of said roof bolting machine reaches said predetermined maximum distance from the rear end of the continuous miner until a predetermined minimum distance is measured therebetween, m) raising said tramming conveyor from the ground to convey coal, and n) initiating the sequential cutting operation of step i).

7. Apparatus for controlling the operation of a continuous underground mining system including a continuous miner having cutting means, a roof bolting machine having a front end operatively connected to and following a rear end of the continuous miner, an articulated tramming conveyor having an inby end operatively connected to and trailing a rear end of the roof bolting machine, and a control cab operatively connected to and trailing said tramming conveyor, said apparatus comprising:

a) a master computer processor on said continuous miner, b) at least one slave computer processor for controlling elements of said mining system, other than said continuous miner, under the direction of said master computer processor, c) a pair of parallel data communication highways between said master computer processor and said slave computer processor, d) a radio communication path between said master computer processor and an outby end of said tramming conveyor, e) monitoring means for monitoring the functional status of said data communication highways, f) means in said master computer processor for operating said mining system, in response to said monitoring means, in an automatic mining mode of operation when both of said data communication highways are functional, g) means in said master computer processor for operating said mining system, in response to said monitoring means, in a reverse mode of operation if either of said data communication highways fails to function, whereby all mining operations cease and said mining system may be reversed out of a mine hole, and h) means in said master computer processor for operating said mining system, in response to said monitoring means, in a manual, radio-controlled mode of operation using said radio communication path if both data communication highways cease to function, whereby said master computer processor stops all automatic operations and is controlled solely by control signals over said radio communication path.

8. Apparatus as set forth in claim 7 wherein said slave computer processor includes a conveyor computer processor located at said outby end of said tramming conveyor and a roof bolting machine computer processor located on said roof bolting machine.

9. Apparatus as set forth in claim 8 wherein said parallel data communicator highways are a pair of data cables extending along the length of said tramming conveyor from the conveyor computer processor through the roof bolting machine computer processor and to said master computer processor.

10. Apparatus as set forth in claim 7 wherein said radio communication path is a radio wave transmitting cable extending along the length of said tramming conveyor and a radio receiver on said continuous miner which is connected to and supplies control signals to said master computer processor.

11. Apparatus as set forth in claim 10 wherein said radio wave transmitting cable is a coaxial cable.

12. Apparatus as set forth in claim 7 including a cutting control means for controlling a sequential cutting operation of said cutting means on said continuous miner, said cutting control means operating said cutting means to sump inwardly at the top of a coal seam, shear downwardly to the bottom of the coal seam, sump inwardly at the bottom of the coal seam and shear upwardly to the top of the coal seam in continuous repetitive cutting cycles.

* * * * *